US011550252B2

(12) United States Patent
Shinoya et al.

(10) Patent No.: US 11,550,252 B2
(45) Date of Patent: Jan. 10, 2023

(54) DRAWER INCLUDING DRAWER FRAME, CONNECTOR, AND HOLDER HOLDING THE SAME AND MOVABLE RELATIVE TO DRAWER FRAME

(71) Applicant: BROTHER KOGYO KABUSHIKI KAISHA, Nagoya (JP)

(72) Inventors: Shota Shinoya, Nisshin (JP); Isao Kishi, Nagoya (JP); Yuwen Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/892,448

(22) Filed: Jun. 4, 2020

(65) Prior Publication Data

US 2020/0387104 A1 Dec. 10, 2020

(30) Foreign Application Priority Data

Jun. 6, 2019 (JP) ..... JP2019-106434

(51) Int. Cl.
*G03G 15/00* (2006.01)
*G03G 21/18* (2006.01)
*G03G 21/16* (2006.01)

(52) U.S. Cl.
CPC ..... *G03G 15/751* (2013.01); *G03G 21/1652* (2013.01); *G03G 21/1885* (2013.01)

(58) Field of Classification Search
CPC ..... G03G 2221/1684; G03G 21/1652; G03G 15/0863; G03G 21/1647; G03G 21/1853;
(Continued)

(56) References Cited

U.S. PATENT DOCUMENTS

2010/0135693 A1 6/2010 Okabe et al.
2011/0075213 A1* 3/2011 Murayama ..... G03G 15/0822 358/1.15

(Continued)

FOREIGN PATENT DOCUMENTS

CN 103631109 A 3/2014
CN 104090471 A 10/2014

(Continued)

OTHER PUBLICATIONS

First Office Action issued in corresponding Chinese Patent Application No. 202010509790.1, dated Sep. 30, 2022.

*Primary Examiner* — Jessica L Eley
(74) *Attorney, Agent, or Firm* — Merchant & Gould P.C.

(57) ABSTRACT

A drawer includes: a photosensitive drum; a drawer frame; a connector; a drawer memory; and a holder. The photosensitive drum is rotatable about a drum axis extending in a first direction. The drawer frame holds the photosensitive drum. The drawer frame has an outer surface. The connector has a plurality of terminals arrayed in an arraying direction. The drawer memory stores information on the photosensitive drum. The drawer memory is electrically connectable to at least one of the plurality of terminals. The holder is positioned at the outer surface of the drawer frame and holds the connector. The holder is movable relative to the drawer frame in the arraying direction of the plurality of terminals.

27 Claims, 16 Drawing Sheets

(58) Field of Classification Search
CPC ..... G03G 21/1867; G03G 21/1885; G03G 21/1642; G03G 2221/1654; G03G 2221/166; G03G 21/1878
See application file for complete search history.

(56) References Cited

U.S. PATENT DOCUMENTS

| | | | | |
|---|---|---|---|---|
| 2011/0164897 | A1 | 7/2011 | Kikuchi | |
| 2014/0169828 | A1* | 6/2014 | Ohta | G03G 21/1623 399/110 |
| 2016/0258490 | A1* | 9/2016 | Sasaki | G03G 15/80 |
| 2017/0227907 | A1* | 8/2017 | Makino | G03G 15/553 |
| 2017/0269543 | A1* | 9/2017 | Itabashi | G03G 21/1661 |
| 2019/0041792 | A1* | 2/2019 | Kishi | G03G 21/1623 |
| 2020/0272086 | A1* | 8/2020 | Shinoya | G03G 21/1633 |

FOREIGN PATENT DOCUMENTS

| | | | |
|---|---|---|---|
| JP | 2010-128336 | A | 6/2010 |
| JP | 2019-28345 | A | 2/2019 |

* cited by examiner

DRAWER INCLUDING DRAWER FRAME, CONNECTOR, AND HOLDER HOLDING THE SAME AND MOVABLE RELATIVE TO DRAWER FRAME

CROSS REFERENCE TO RELATED APPLICATION

This application claims priority from Japanese Patent Application No. 2019-106434 filed Jun. 6, 2019. The entire content of the priority application is incorporated herein by reference.

TECHNICAL FIELD

The present disclosure relates to a drawer, and more particularly, to a drawer of an image forming apparatus.

BACKGROUND

There has been known an electro-photographic type image forming apparatus such as a laser printer and an LED printer. The image forming apparatus includes a drawer. The drawer includes a plurality of photosensitive drums. A plurality of developing cartridges is attachable to and detachable from the drawer. Each of the plurality of developing cartridges includes a developing roller, and upon attachment of the developing cartridge to the drawer, the developing roller provided in the developing cartridge is in contact with a corresponding one of the photosensitive drums of the drawer. The drawer is attachable to and detachable from a housing of a main body of the image forming apparatus in a state where the developing cartridges are attached thereto.

SUMMARY

Also known is a developing cartridge including a storage medium. The storage medium stores therein various data on the developing cartridge. Likewise, installation on the drawer of a storage medium storing various data on the photosensitive drums is required. In case of mounting the storage medium on the drawer, the storage medium should be electrically connected to a controller of the main body of the image forming apparatus through a connector of the drawer and a connector of the main body of the image forming apparatus.

However, positional displacement may occur between the connector of the drawer and the connector of the main body of the image forming apparatus in a case where the drawer is attached to the housing of the main body of the image forming apparatus.

In view of the foregoing, it is an object of the disclosure to provide a drawer ensuring electrical connection between the connector of the drawer and the connector of the main body of the image forming apparatus in which the drawer is accommodated even if positional displacement occurs between the connector of the drawer and the connector of the main body of the image forming apparatus.

In order to attain the above and other objects, according to one aspect, the disclosure provides a drawer. The drawer includes: a photosensitive drum; a drawer frame; a connector; a drawer memory; and a holder. The photosensitive drum is rotatable about a drum axis extending in a first direction. The drawer frame holds the photosensitive drum. The drawer frame has an outer surface. The connector has a plurality of terminals arrayed in an arraying direction. The drawer memory stores information on the photosensitive drum. The drawer memory is electrically connectable to at least one of the plurality of terminals. The holder is positioned at the outer surface of the drawer frame and holds the connector. The holder is movable relative to the drawer frame in the arraying direction of the plurality of terminals.

According to another aspect, the disclosure provides a drawer for use in a main body of an image forming apparatus. The drawer includes: a photosensitive drum; a drawer frame; a connector; a drawer memory; and a holder. The photosensitive drum is rotatable about a drum axis extending in a first direction. The drawer frame holds the photosensitive drum. The drawer frame has an outer surface. The connector has a terminal. The drawer memory stores information on the photosensitive drum. The drawer memory is electrically connectable to the terminal. The holder is positioned at the outer surface of the drawer frame. The holder holds the connector. The holder is movable relative to the drawer frame in a direction crossing an attachment direction in which the drawer is to be attached to the main body of the image forming apparatus.

According to still another aspect, the disclosure provides a drawer. The drawer includes: a photosensitive drum; a drawer frame; a connector; a drawer memory; and a holder. The photosensitive drum is rotatable about a drum axis extending in a first direction. The drawer frame holds the photosensitive drum. The drawer frame has an outer surface. The connector has a terminal. The drawer memory stores information on the photosensitive drum. The drawer memory is electrically connectable to the terminal. The holder is positioned at the outer surface of the drawer frame. The holder holds the connector. The holder is movable relative to the drawer frame in at least one of the first direction and a direction crossing the first direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described with reference to the accompanying drawings.

In the following description, a direction in which a rotation axis of a photosensitive drum (a drum axis) extends will be referred to as a first direction. Among directions in which a plurality of terminals T of a connector is planarly arrayed, a direction perpendicular to the first direction will be referred to as a second direction. A direction crossing both the first direction and the second direction will be referred to as a third direction. Preferably, the second direction and the third direction are perpendicular to each other. A direction in which a plurality of photosensitive drums is arrayed will be referred to as a fourth direction. Preferably, the first direction and the fourth direction are perpendicular to each other. A direction perpendicular to both the first direction and the fourth direction will be referred to as a fifth direction. Preferably, the fifth direction is perpendicular to both the first direction and the fourth direction.

1. Configuration of Image Forming Apparatus

Figure 1:
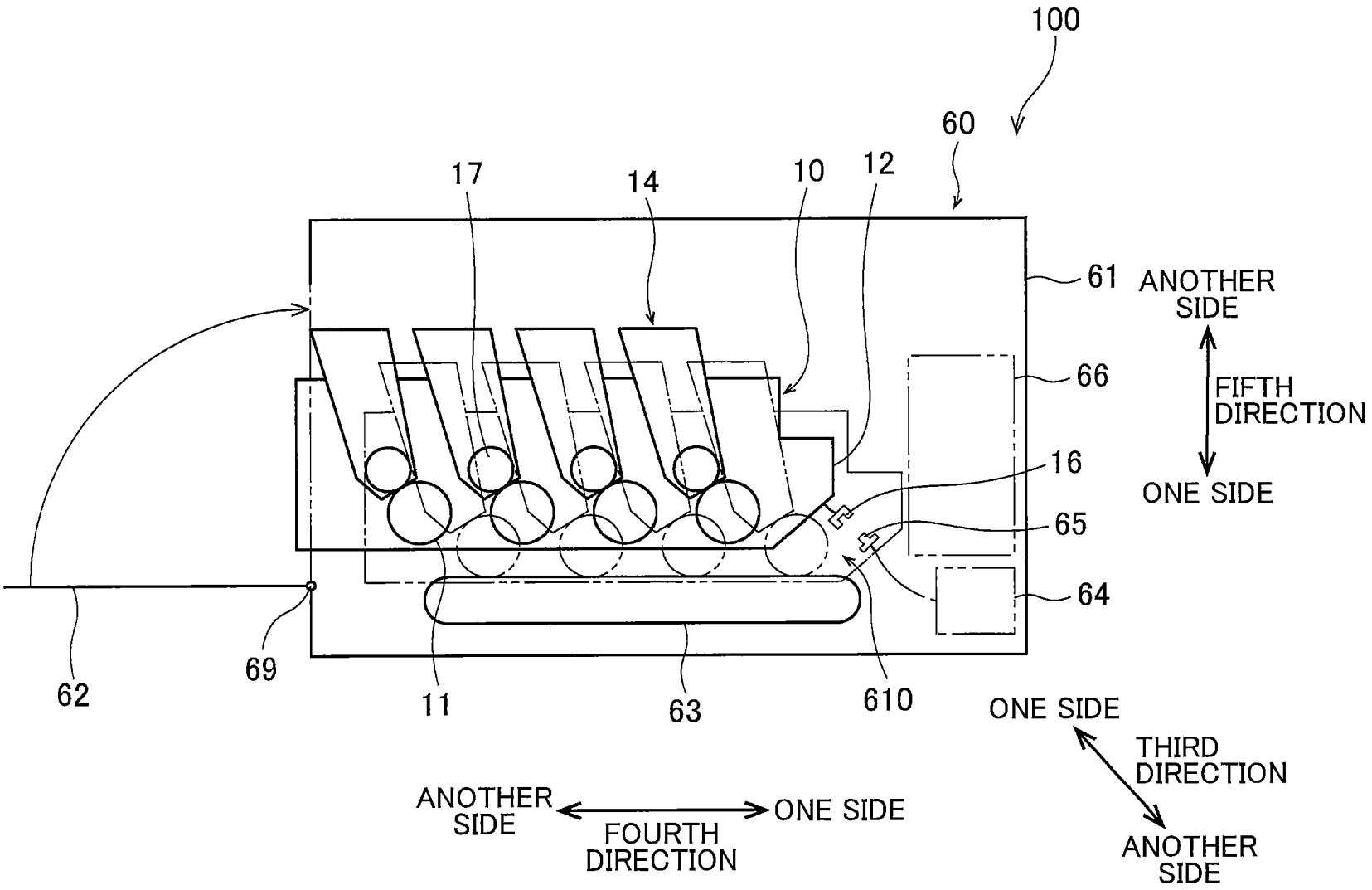
FIG. 1 is a schematic view of an image forming apparatus including a drawer according to one embodiment of the present disclosure.
Figure 2:
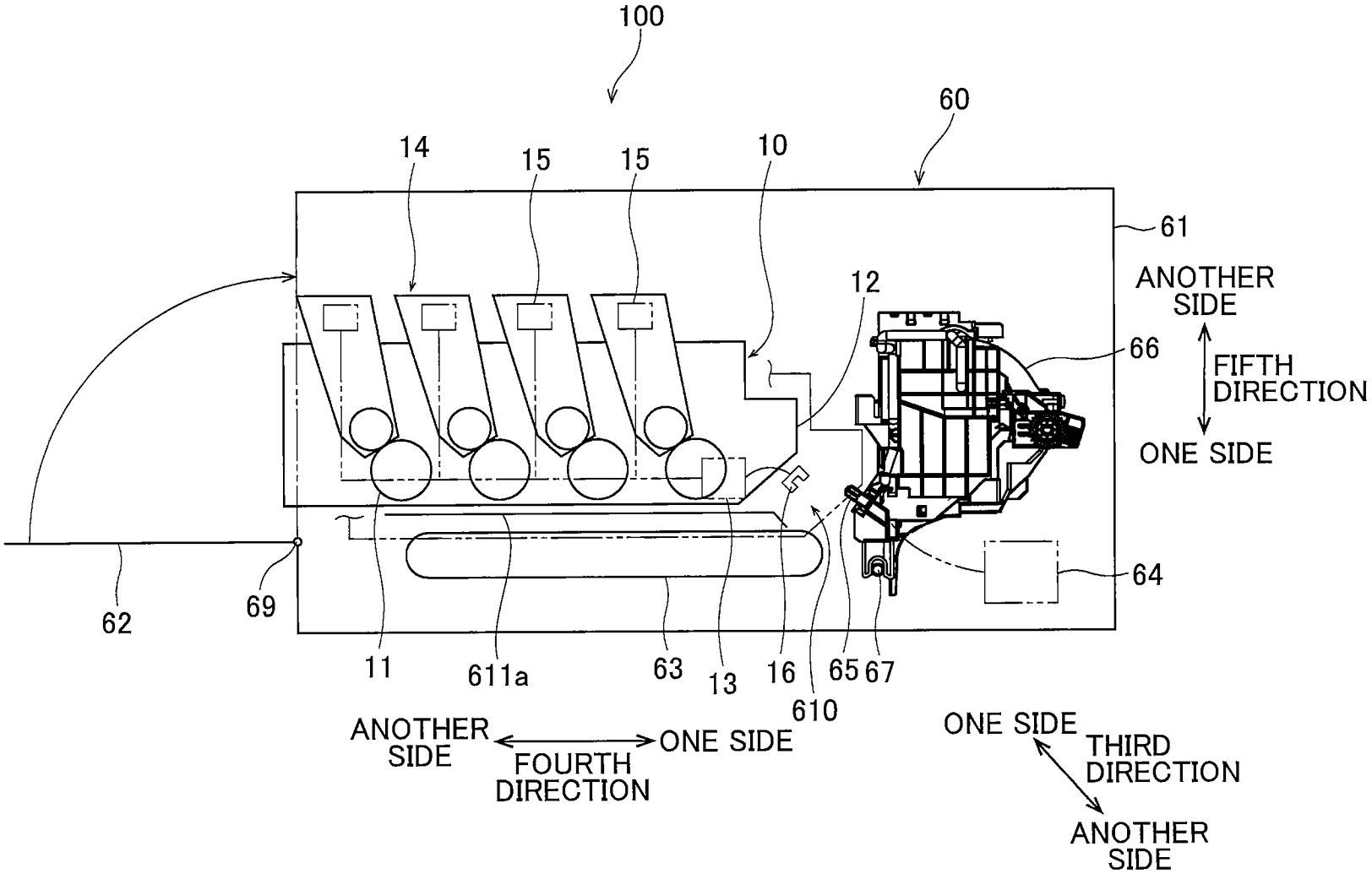
FIG. 2 is another schematic view of the image forming apparatus including the drawer according to the embodiment of the present disclosure.

FIGS. 1 and 2 each illustrates a schematic view of an image forming apparatus 100. The image forming apparatus 100 is an electro-photographic type printer such as a laser printer and an LED printer. As illustrated in FIGS. 1 and 2, the image forming apparatus 100 includes a drawer 10 and a main body 60.

<1-1. Construction of Drawer>

Figure 3:
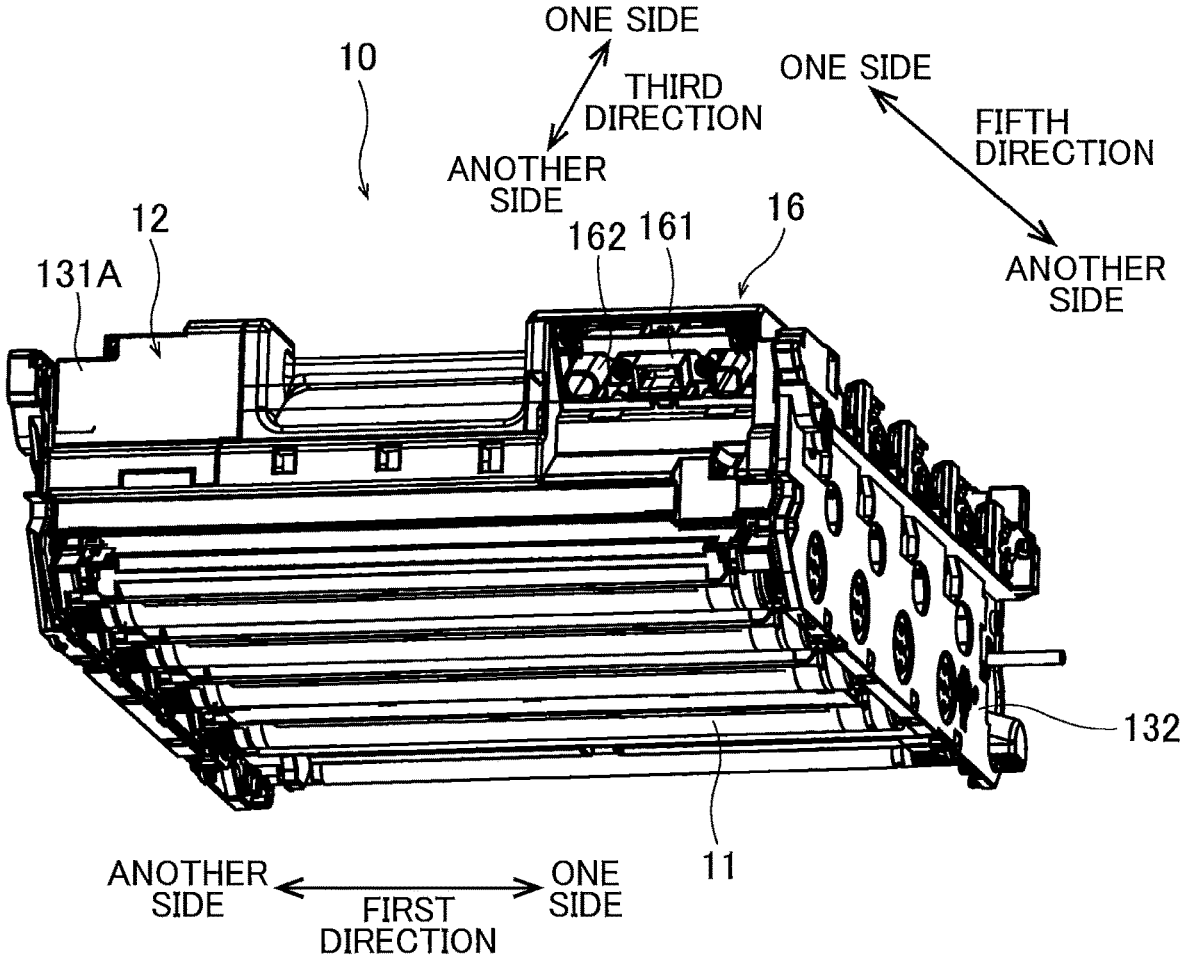
FIG. 3 is a perspective view of the drawer according to the embodiment of the present disclosure.
Figure 4:
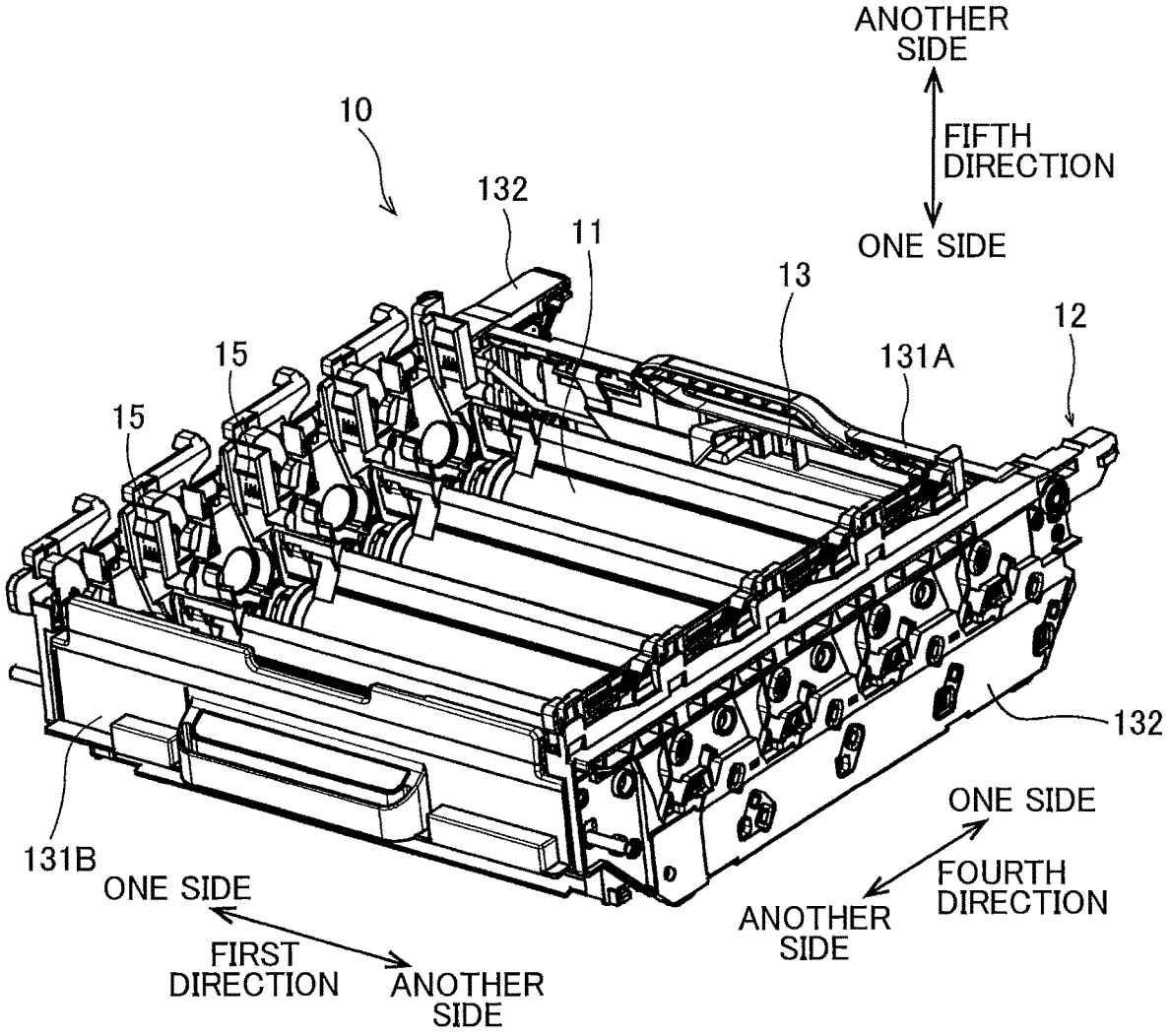
FIG. 4 is another perspective view of the drawer according to the embodiment of the present disclosure.
Figure 5:
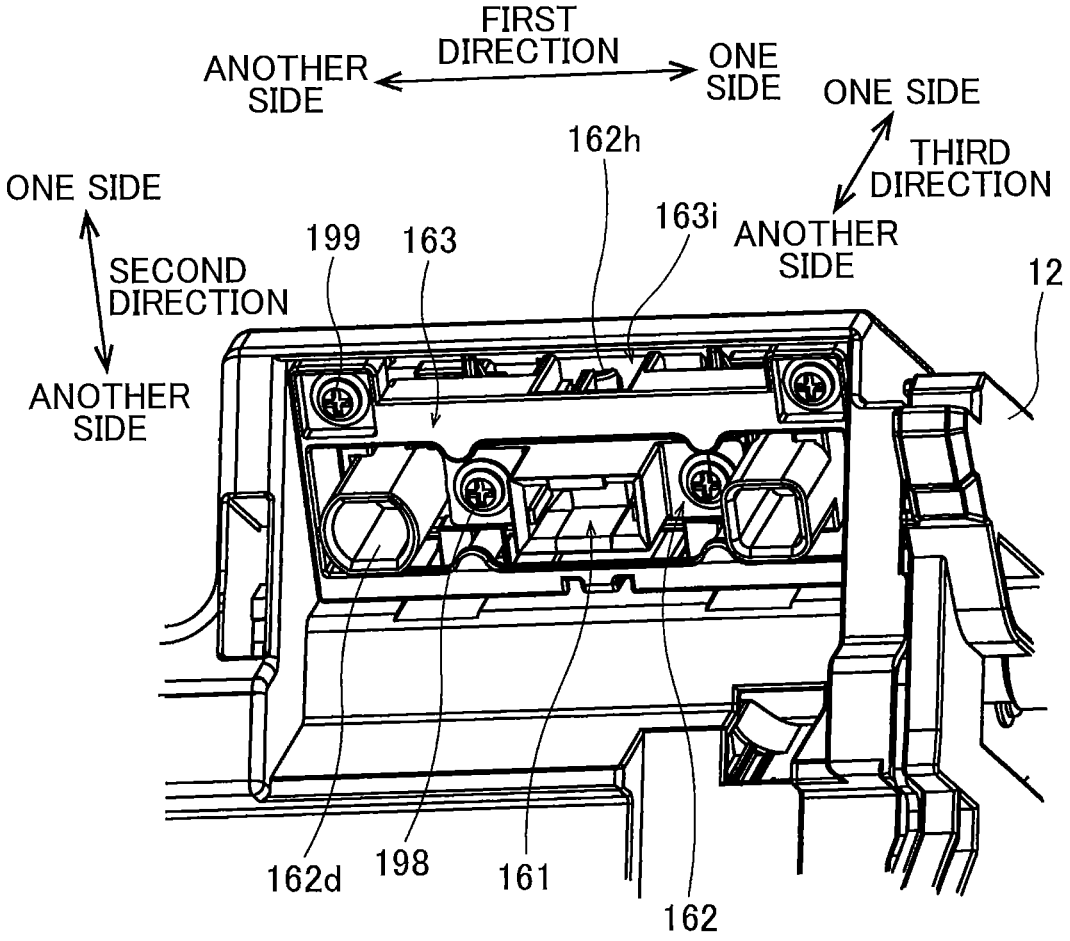
FIG. 5 is an enlarged perspective view illustrating a part of the drawer according to the embodiment of the present disclosure, and particularly illustrating a drawer-side connector of a drawer-side connecting portion.

Next, the construction of the drawer 10 will be described. FIGS. 3 and 4 each illustrates a perspective view of the drawer 10. As illustrated in FIGS. 1 through 4, the drawer 10 includes four photosensitive drums 11, a drawer frame 12, a drawer memory 13, four developing cartridges 14, and a drawer-side connecting portion 16. Each of the developing cartridges 14 includes a toner memory 15.

As illustrated in FIGS. 3 and 4, each of the photosensitive drums 11 has a hollow cylindrical shape having a drum axis which is a rotation axis extending in the first direction. The photosensitive drums 11 is rotatable about the drum axis thereof. The photosensitive drums 11 has an outer peripheral surface covered with photosensitive material.

As illustrated in FIGS. 3 and 4, the drawer frame 12 is configured to hold the four photosensitive drums 11. The photosensitive drums 11 are arrayed in a line in the fourth direction with a space between neighboring photosensitive drums 11. The drawer frame 12 includes two base plates 131A and 131B, and two side plates 132. The two base plates 131A and 131B are spaced away from each other in the fourth direction and are parallel to each other. In other words, the base plate 131A is positioned at one side in the fourth direction, and the base plate 131B is positioned at another side in the fourth direction, as illustrated in FIGS. 3 and 4. The two side plates 132 are spaced away from each other in the first direction and are parallel to each other. In other words, one of the side plates 132 is positioned at one side in the first direction, and the other one of the base plates 132 is positioned at another side in the first direction, as illustrated in FIGS. 3 and 4.

Each of four developing cartridges 14 is attachable to and detachable from the drawer frame 12. As illustrated in FIGS. 1 and 2, the developing cartridge 14 includes a casing in which toner as one example of developing agent is accommodated. The four developing cartridges 14 accommodate therein toner of different colors for example, cyan, magenta, yellow, and black.

In the present embodiment, each of the developing cartridges 14 includes a developing roller 17. The developing roller 17 is a hollow cylindrical member having a developing axis which is a rotation axis extending in the first direction. The developing roller 17 is rotatable about the developing axis. Upon attachment of the developing cartridge 14 to the drawer frame 12, an outer peripheral surface of the developing roller 17 is brought into contact with the outer peripheral surface of a corresponding one of the photosensitive drums 11.

The drawer memory 13, the toner memory 15, and the drawer-side connecting portion 16 will be described later.

<1-2. Structure of Main Body of Image Forming Apparatus>

Next, the structure of the main body 60 of the image forming apparatus 100 will be described. As illustrated in FIGS. 1 and 2, the main body 60 includes a housing 61, a front cover 62, a transfer belt 63, a controller 64, a main body-side connecting portion 65, a discharge unit 66, and a reference shaft 67.

The housing 61 has a generally rectangular parallelepiped shape, and provides an internal space 610. The housing 61 includes a pair of side frames 611 (FIG. 13) spaced away from each other in the first direction and are parallel to each other. The drawer 10 is attachable to and detachable from the housing 61 in the fourth direction. Specifically, the drawer 10 to which the developing cartridges 14 are attached is attachable to and detachable from the housing 61 in the fourth direction. Further, the housing 61 accommodates therein four light sources (not illustrated), the transfer belt 63, the controller 64, the main body-side connecting portion 65, the discharge unit 66, and the reference shaft 67.

The front cover 62 is movable between an open position indicated by a solid line in FIG. 1 and a closed position indicated by a chain double-dashed line in FIG. 1. Specifically, the front cover 62 is pivotally movable about a hinge 69 extending in the first direction. The internal space 610 of the housing 61 is opened in a state where the front cover 62 is at the open position, and the internal space 610 is closed in a state where the front cover 62 is at the closed position.

A user of the image forming apparatus 100 can move the drawer 10 to which the developing cartridges 14 are attached in the fourth direction in the state where the front cover 62 is at the open position. Hence, the user can move the drawer 10 between a released position where at least a part of the drawer 10 is positioned outside the internal space 610 and an attachment position where the drawer 10 in its entirety is set in the internal space 610.

The transfer belt 63 is an endless belt configured to convey a sheet. In a state where the drawer 10 is at the attachment position, the transfer belt 63 is positioned opposite to the developing rollers 17 with respect to the photosensitive drums 11. In the state where the drawer 10 is at the attachment position, an outer peripheral surface of the transfer belt 63 is contactable with the outer peripheral surfaces of the photosensitive drums 11.

The discharge unit 66 is configured to discharge and guide a sheet on which an image is formed to a discharge tray (not illustrated) positioned at an upper portion of the housing 61. The discharge unit 66 includes a conveyer passage along which the sheet is conveyed to the discharge tray, and a plurality of discharge rollers positioned along the conveyer passage. The discharge unit 66 is positioned at a downstream portion of the internal space 610 which is positioned at a downstream side in the fourth direction. In other words, the discharge unit 66 is positioned at an inner surface of the housing 61 positioned at the one side (FIGS. 1 and 2) in the fourth direction.

The controller 64 includes a processor such as a CPU, and a main memory which is a readable/writable storage medium. A flash ROM and an EEPROM are available as the main memory. The main memory stores therein a computer program for controlling operation to be performed in the image forming apparatus 100. The processor is configured to perform various processes in accordance with the computer program stored in the main memory. That is, the processor is configured to execute various processes such as a printing process.

The main body-side connecting portion 65 and the reference shaft 67 will be described later.

<1-3. Structure of Electrical Connection>

Next, a structure of an electrical connection in the image forming apparatus 100 will be described. Specifically, electrically connecting structure including the drawer memory 13, the toner memory 15, the drawer-side connecting portion 16, and the main body-side connecting portion 65 will be described with reference to FIGS. 2 and 4.

<1-3-1. Components for Electrical Connection Provided in Drawer>

The drawer 10 includes the drawer memory 13 and the drawer-side connecting portion 16 as components for electrical connection.

The drawer memory 13 is configured to store therein information on at least one of the four photosensitive drums 11. Specifically, the drawer memory 13 stores therein identification information for discriminating the photosensitive drum 11 from each other, and drum life information indicative of the service life of the photosensitive drum 11. The drum identification information is a serial number, for example. The drum life information is at least one of a number of rotations of the photosensitive drum 11 and a number of sheets printed using the photosensitive drum 11.

In the present embodiment, as illustrated in FIG. 4, the drawer memory 13 is positioned at an inner surface of the base plate 131A positioned at the one side in the fourth direction among the pair of base plates 131A and 131B arrayed in the fourth direction. A drawer-side circuit board is provided on the base plate 131A, and the drawer memory 13 is positioned on the drawer-side circuit board. The drawer-side circuit board is configured to relay electrical connection between the toner memory 15 and the drawer-side connecting portion 16.

That is, in a state where the drawer 10 to which the developing cartridges 14 are attached is installed in the internal space 610 of the main body 60, the controller 64 and the toner memory 15 are electrically connected to each other through the drawer-side circuit board. The drawer-side circuit board is capable of relaying information between the controller 64 and the toner memory 15. For example, the drawer-side circuit board can acquire information stored in the toner memory 15 through a wiring harness, and can output the acquired information to the controller 64 through a wiring harness. Further, the drawer-side circuit board can acquire information supplied from the controller 64 through the wiring harness, and can output the acquired information to the toner memory 15 through the wiring harness.

Figure 7:
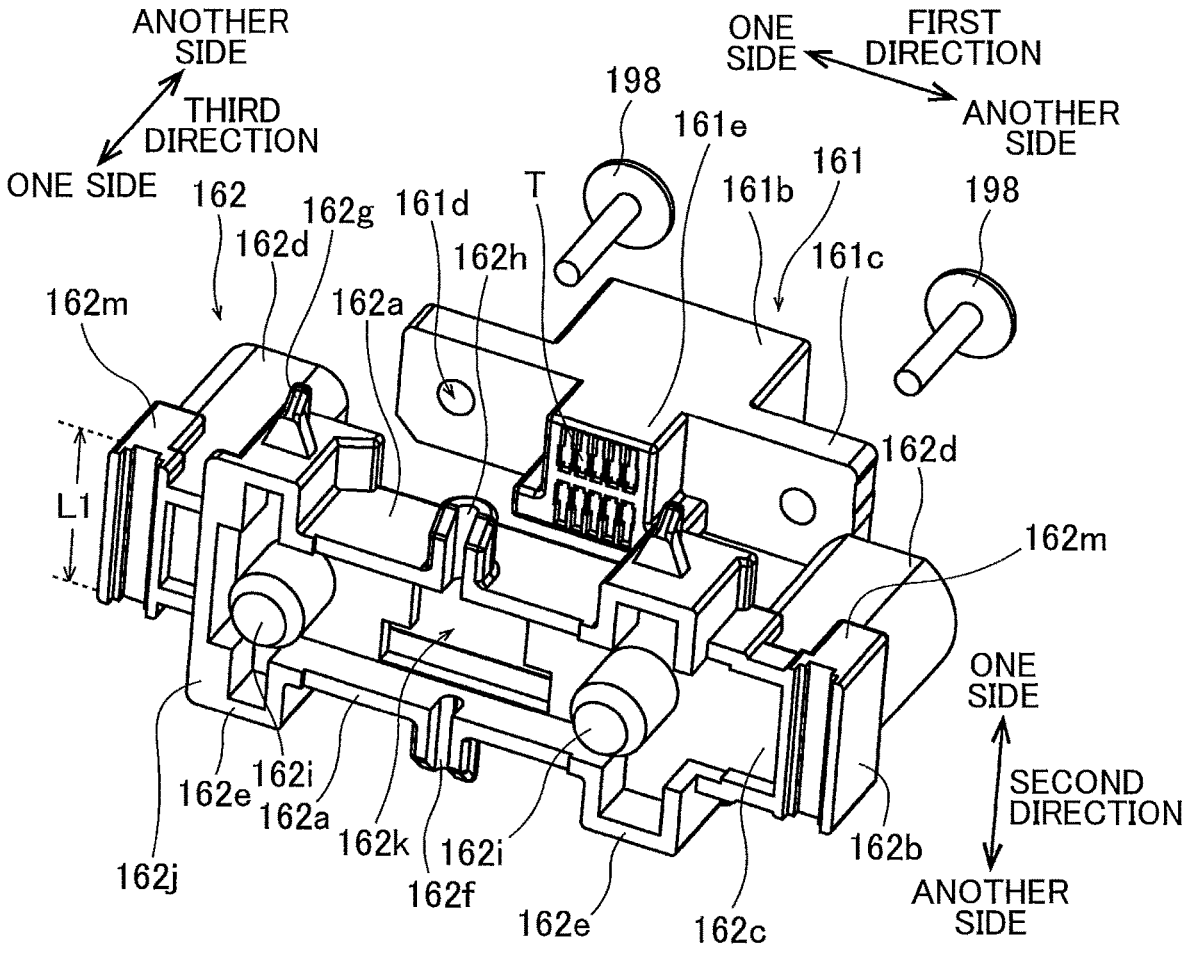
FIG. 7 is an exploded perspective view illustrating a holder, the drawer-side connector, and screws those being components constituting the drawer-side connecting portion.

As illustrated in FIG. 3, the drawer-side connecting portion 16 is positioned at an outer surface of the base plate 131A positioned at the one side in the fourth direction among the pair of base plates 131A and 131B arrayed in the fourth direction. The drawer-side connecting portion 16 includes a drawer-side connector 161 and a drawer-side holder 162. The drawer-side connector 161 is a female connector. The drawer-side connector 161 includes a plurality of terminals T (FIG. 7). The plurality of terminals T are positioned at an end surface of the drawer-side connector 161. As illustrated in FIG. 7, the plurality of terminals T are arrayed on the end surface in both the first direction and the second direction perpendicular to the first direction.

One of a voltage wiring, a clock wiring, and a data wiring extends from each terminal T. These wirings are connected to the drawer-side circuit board mounting thereon the drawer memory 13 (FIG. 4). Further, these wirings are electrically connected to the corresponding toner memory 15 through the drawer-side circuit board. These wirings are bundled as the wiring harness. In this way, the drawer-side connector 161 is electrically connected to the drawer memory 13 and the toner memory 15.

In a case where the drawer-side connecting portion 16 is electrically connected to the main body-side connecting portion 65 (described later), the drawer memory 13 and the toner memory 15 are electrically connected to the controller 64. Hence, the controller 64 is communicable with the drawer memory 13 and the toner memory 15.

The drawer-side holder 162 extends in the third direction as illustrated in FIG. 3. The drawer-side holder 162 holds the drawer-side connector 161 therein. That is, the drawer-side holder 162 encircles an outer contour of the drawer-side connector 161. The drawer-side holder 162 is configured to hold the drawer-side connector 161 to be movable in the first direction, the second direction, and the third direction. Detailed structure of the drawer-side connecting portion 16 will be described later.

<1-3-2. Component for Electrical Connection Provided in Developing Cartridge>

The developing cartridge 14 includes the toner memory 15 as a component for electrical connection.

The toner memory 15 is provided at each developing cartridge 14 individually. The toner memory 15 stores therein toner identification information for discriminating the developing cartridge 14 from each other, and toner life information indicative of the service life of the developing cartridge 14. The toner identification information is a serial number, for example. The toner life information is at least one of a number of rotations of the developing roller 17, a number of sheets printed using the developing roller 17, and a number of dots outputted using the developing roller 17.

As illustrated in FIGS. 3 and 4, each side plate 132 has one end portion and another end portion in the fifth direction, the one end portion being positioned at one side in the fifth direction, the other end portion being positioned at another side in the fifth direction. In the present embodiment, in a state where the developing cartridges 14 are attached to the drawer 10, the plurality of toner memories 15 are positioned at the other end portion in the fifth direction of the side plate 132 positioned at the one side in the first direction. The plurality of toner memories 15 are arrayed with each other in the fourth direction with a space between neighboring toner memories 15.

<1-3-3. Component for Electrical Connection Provided in Main Body>

The main body 60 of the image forming apparatus 100 includes the main body-side connecting portion 65 as a component for electrical connection.

Figure 13:
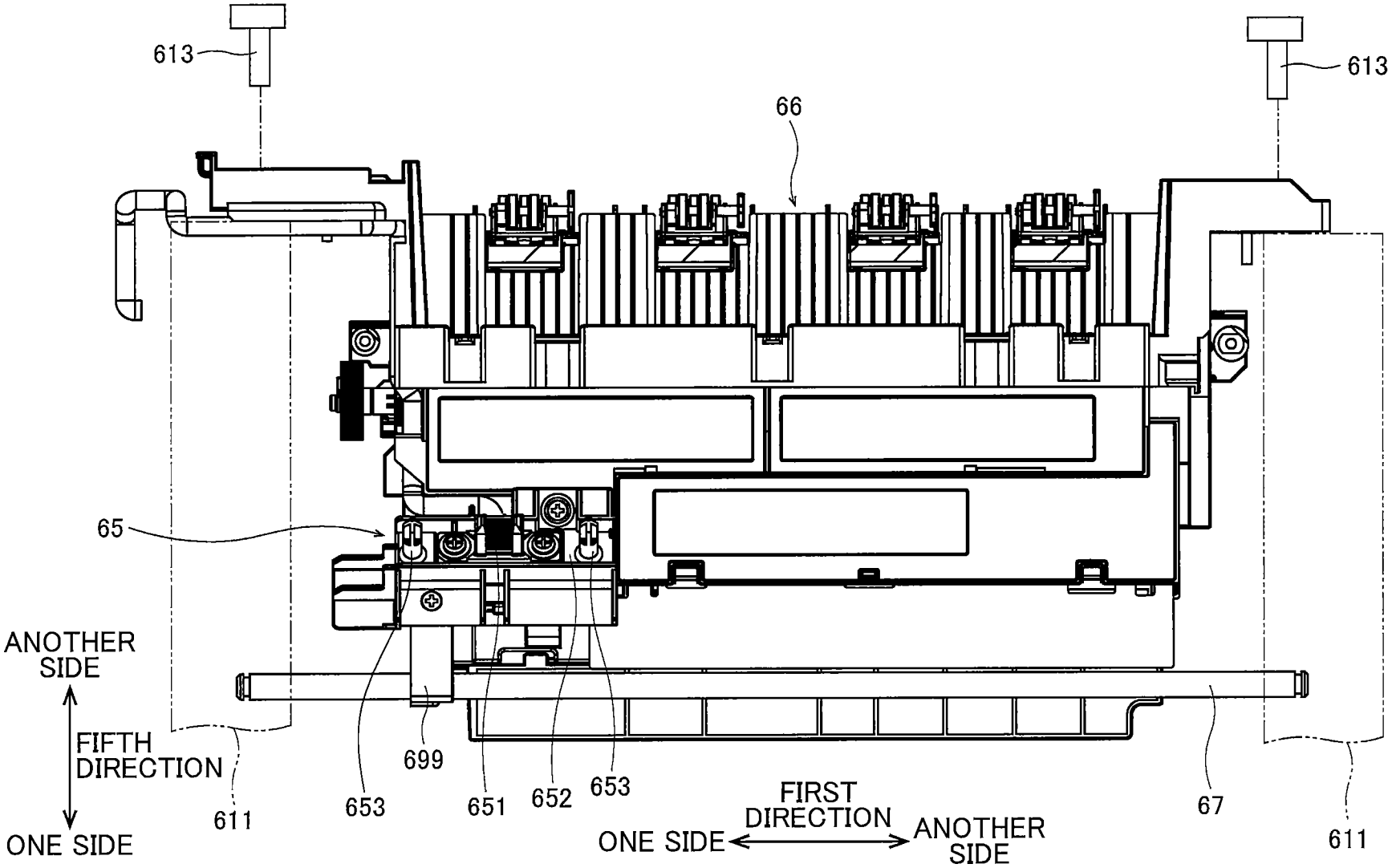
FIG. 13 is a view illustrating a discharge unit and the reference shaft as viewed from another side in the fourth direction.

FIG. 13 is a view illustrating the main body-side connecting portion 65 as viewed from the other side in the fourth direction. As illustrated in FIG. 13, the main body-side connecting portion 65 includes a main body-side connector 651, a main body-side holder 652, and a pair of protrusions 653. The main body-side connector 651 is a male connector. The main body-side connector 651 includes a plurality of terminals. The plurality of terminals are positioned at an outer surface of the main body-side connector 651. The main body-side holder 652 holds the main body-side connector 651.

One of a voltage wiring, a clock wiring, and a data wiring extends from each terminal. Each of these wirings is connected to a corresponding terminal of the controller 64. These wirings are bundled as the wiring harness. In this way, the main body-side connector 651 is electrically connected to the controller 64.

The main body-side connecting portion 65 has one end portion and another end portion in the first direction, the one end portion being positioned at the one side in the first direction, the other end portion being positioned at the other side in the first direction. One of the pair of protrusions 653 is positioned at the one end portion of the main body-side connecting portion 65, and extends in the third direction. The other one of the protrusions 653 is positioned at the other end portion of the main body-side connecting portion 65, and extends in the third direction. The main body-side connector 651 is positioned between the pair of protrusions 653.

In a state where the drawer 10 is at the attachment position as a result of insertion of the drawer 10 into the internal space 610 of the housing 61, the drawer-side connecting portion 16 is connected to the main body-side connecting portion 65. Hence, each of the terminals T of the drawer-side connector 161 is connected to a corresponding one of terminals of the main body-side connector 651.

According to the image forming apparatus 100 thus constructed, the controller 64 permits a motor (not illustrated) to start rotation for performing a printing process. The photosensitive drums 11 and the developing rollers 17 are rotated by the rotation of the motor. Further, the controller 64 supplies electric power to each of chargers (not illustrated) to charge the surface of a corresponding one of the photosensitive drums 11. Further, the controller 64 permits a light source (not illustrated) to irradiate light so as to expose the outer peripheral surface of a corresponding one of the photosensitive drums 11 to light. Hence, an electrostatic latent image corresponding to a printing image is formed on the outer peripheral surface of the photosensitive drum 11.

Then, toner carried on the outer peripheral surface of the developing roller 17 is transferred to a region of the electrostatic latent image. Accordingly, a toner image is formed on the outer peripheral surface of the photosensitive drum 11. A sheet is then conveyed to a portion between the photosensitive drum 11 and the transfer belt 63. Hence, the toner image is transferred from the outer peripheral surface of the photosensitive drum 11 to the sheet. The sheet carrying the toner image is then conveyed to a fixing unit (not illustrated). Hence, the toner image is thermally fixed to the sheet. In this way, an image is printed on the sheet.

Incidentally, during the above-described printing operation, the controller 64 acquires information on the service life of the photosensitive drum 11, the service life of the developing cartridge 14, and the like, by way of communication with the drawer memory 13 and the toner memory 15. The controller 64 sets a suitable printing mode or ceases the printing operation depending on the situation in accordance with the acquired information.

<1-4. Structure of Drawer-Side Connecting Portion>

Next, a structure of the drawer-side connecting portion 16 will be described with reference to FIGS. 5 through 9. The drawer-side connecting portion 16 includes the drawer-side connector 161, the drawer-side holder 162, a cover 163, and four coil springs (elastic member) 164, as illustrated in FIGS. 5 through 9.

<1-4-1. Structure of Cover>

Figure 6:
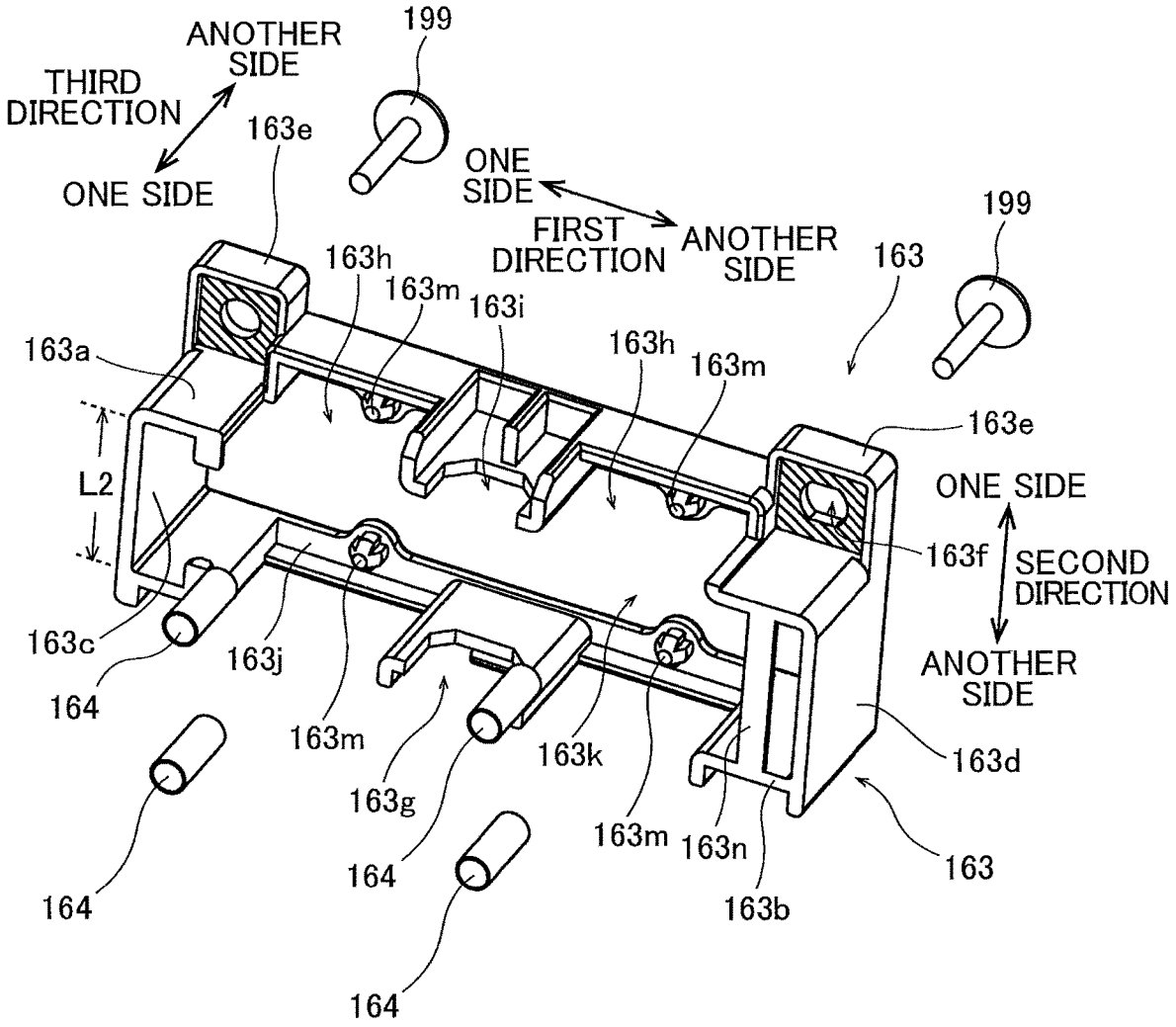
FIG. 6 is a perspective view illustrating a cover, coil springs, and screws those being components constituting the drawer-side connecting portion.
Figure 9:
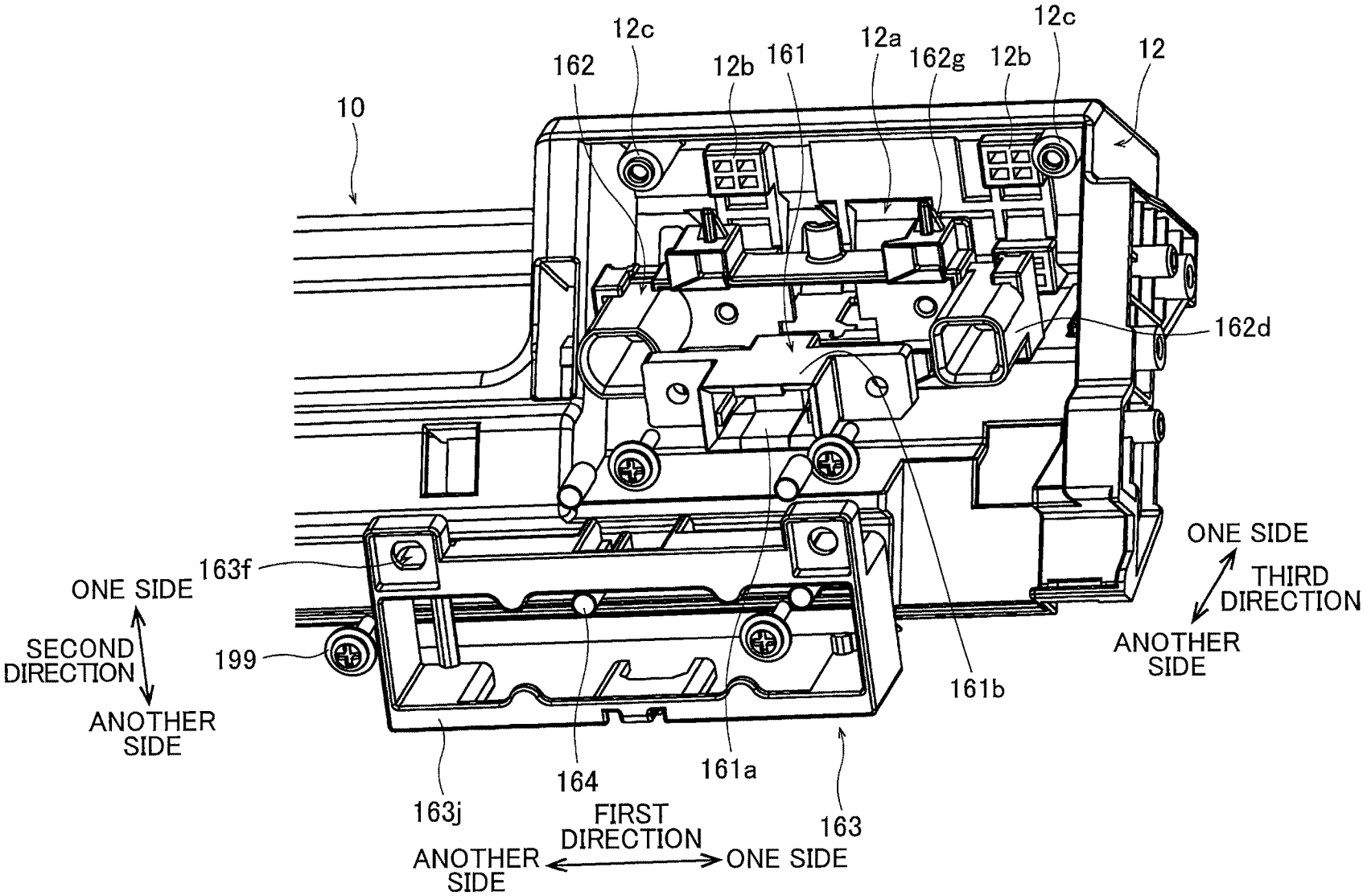
FIG. 9 is another exploded perspective view of the drawer-side connecting portion and a drawer frame.

A structure of the cover 163 will be described first with reference to FIGS. 6 and 9. FIG. 6 is a perspective view illustrating the cover 163, the coil springs 164, and screws 199. FIG. 9 is an exploded perspective view of the drawer-side connecting portion 16. FIG. 9 also illustrates a perspective view of the cover 163 as viewed in a direction different from the viewing direction in FIG. 6.

The cover 163 has a generally rectangular shape as viewed in the third direction. The cover 163 includes a first side wall 163*a*, a second side wall 163*b*, a third side walls 163*c*, a fourth side wall 163*d*, two extending portions 163*e*, two flat surface portions 163*j*, four second spring seats 163*m*, and a bar 163*n*. The cover 163 is formed with two through-holes 163*f*, a first groove 163*g*, two second grooves 163*h*, a third groove 163*i*, and a through-hole 163*k*.

The cover 163 has a generally rectangular profile as viewed in the third direction. The through-hole 163*k* is positioned at a center portion of the cover 163. The through-hole 163*k* has an inner peripheral surface in a form of a rectangular shape having a pair of long sides and a pair of short sides in conformance with the outer profile of the cover 163.

The first side wall 163*a* and the second side wall 163*b* are arrayed with each other in the second direction with a space therebetween. The first side wall 163*a* is at one end of the cover 163 in the second direction, the one end being positioned at one side in the second direction. The second side wall 163*b* is at another end of the cover 163 in the second direction, the other end being positioned at another side in the second direction. The first side wall 163*a* and the second side wall 163*b* are generally flat extending perpendicular to the second direction. The first side wall 163*a* and the second side wall 163*b* respectively define the pair of long sides of the through-hole 163*k*.

The first side wall 163*a* has one end portion and another end portion in the first direction, the one end portion being positioned at the one side in the first direction, the other end portion being positioned at the other side in the first direction. The second side wall 163*b* has one end portion and another end portion in the first direction, the one end portion being positioned at the one side in the first direction, the other end portion being positioned at the other side in the first direction.

The first side wall 163*a* also has one end portion and another end portion in the third direction, the one end portion being positioned at one side in the third direction, the other end portion being positioned at another side in the third direction. The second side wall 163*b* also has one end portion and another end portion in the third direction, the one end portion being positioned at the one side in the third direction, the other end portion being positioned at the other side in the third direction.

The third side wall 163*c* and the fourth side wall 163*d* are arrayed with each other in the first direction with a space therebetween. The third side wall 163 is at one end of the cover 163 in the first direction, the one end being positioned at the one side in the first direction. The fourth side wall 163*d* is at another end of the cover 163 in the first direction, the other end being positioned at the other side in the first direction. The third side wall 173*c* and the fourth side wall 163*d* are generally flat extending perpendicular to the first direction.

The third side wall 163*c* has one end portion and another end portion in the second direction, the one end portion being positioned at one side in the second direction, the other end portion being positioned at another side in the second direction. The fourth side wall 163*d* has one end portion and another end portion in the second direction, the one end portion being positioned at the one side in the second direction, the other end portion being positioned at the other side in the second direction.

The one end portion in the second direction of the third side wall 163*c* is connected to the one end portion in the first direction of the first side wall 163*a*. The other end portion in the second direction of the third side wall 163*c* is connected to the one end portion in the first direction of the second side wall 163*b*. The one end portion in the second direction of the fourth side wall 163*d* is connected to the other end portion in the first direction of the first side wall 163*a*. The other end portion in the second direction of the fourth side wall 163*d* is connected to the other end portion in the first direction of the second side wall 163*b*.

The two extending portions 163*e* are arrayed with each other in the first direction with a space therebetween. One of the extending portions 163*e* extends toward the one side in the second direction from the one end portion in the first direction of the first side wall 163*a*. The other one of the extending portions 163*e* extends toward the one side in the second direction from the other end portion in the first direction of the first side wall 163*a*. Each of the extending portions 163*e* has a flat surface portion extending perpendicular to the third direction.

Each of the extending portions 163*e* is formed with a through-hole 163*f*. Each of the through-holes 163*f* extends throughout a thickness of the flat surface portion of a corresponding one of the extending portion 163*e* in the third direction.

The first groove 163*g* is positioned at a center portion in the first direction of the second side wall 163*b*. The first groove 163*g* is positioned at one side in the third direction of the second side wall 163*b*. The first groove 163*g* extends throughout a thickness of the second side wall 163*b* in the second direction. The first groove 163*g* has open end at one side in the third direction. The first groove 163*g* has an inner surface whose width in the first direction is gradually reduced toward another side in the third direction.

The third groove 163*i* is positioned at a center portion in the first direction of the first side wall 163*a*. The third groove 163*i* is positioned at the one side in the third direction of the first side wall 163*a*. The third groove 163*i* extends throughout a thickness of the first side wall 163*a* in the second direction. The third groove 163*i* has an open end at the one side in the third direction. The third groove 163*i* has an inner surface whose width in the first direction is gradually reduced toward the other side in the third direction. The third groove 163*i* is overlapped with the first groove 163*g* as viewed in the second direction.

The two second grooves 163*h* are positioned at the first side wall 163*a*. The two second grooves 163*h* are positioned opposite to each other with respect to the third groove 163*i*. Each of the second grooves 163*h* extends throughout a thickness of the first side wall 163*a* in the second direction. Each of the second grooves 163*h* has an open end at the one side in the third direction. Each of the second grooves 163*h* has an inner surface having a rectangular shape as viewed in the second direction.

The two flat surface portions 163*j* extend perpendicular to the third direction. One of the flat surface portions 163*j* extends toward the second side wall 163*b* (toward the through-hole 163*k*) in the second direction from the other end portion of the first side wall 163*a* positioned at the other side in the third direction. The other one of the flat surface portions 163*j* extends toward the first side wall 163*a* (toward the through-hole 163*k*) in the second direction from the other end portion of the second side wall 163*b* positioned at the other side in the third direction.

The one of the flat surface portions 163*j* positioned at one side of the cover 163 in the second direction has two regions opposite to each other with respect to the third groove 163*i*. Two of the four second spring seats 163*m* are respectively provided at the two regions. The other one of the flat surface portions 163*j* positioned at another side of the cover 163 in the second direction has two regions opposite to each other with respect to the first groove 163*g*. Remaining two of the four second spring seats 163*m* are respectively provided at the two regions. Each of the four second spring seats 163*m* is positioned at a corner of an imaginary rectangle positioned in the through-hole 163*k*.

The bar 163*n* is positioned at the one side in the first direction with respect to the fourth side wall 163*d*. In other words, the bar 163*n* is positioned closer to the third side wall 163*c* than the fourth side wall 163*d* is to the third side wall 163*c* in the first direction. The bar 163*n* extends in the second direction. The bar 163*n* has one end portion and another end portion in the second direction, the one end portion being positioned at the one side in the second direction, the other end portion being positioned at the other side in the second direction. The one end portion in the second direction of the bar 163*n* is connected to the one end portion in the third direction of the first side wall 163*a*. The other end portion in the second direction of the bar 163*n* is connected to the one end portion in the third direction of the second wall 163*b*.

<1-4-2. Structure of Drawer-Side Holder>

Next, a structure of the drawer-side holder 162 will be described with reference to FIGS. 7 and 9. FIG. 7 is a perspective view illustrating the drawer-side holder 162, the drawer-side connector 161, and screws 198. FIG. 9 illustrates a perspective view of the drawer-side holder 162 as viewed in a direction different from the viewing direction in FIG. 7.

The drawer-side holder 162 has a generally rectangular box shape. The drawer-side holder 162 includes two first wall portions 162*a*, two second wall portions 162*b*, a partitioning plate 162*c*, two guide portions 162*d*, four polygonal sleeve portions 162*e*, a first protrusion 162*f*, two second protrusions 162*g*, a third protrusion 162*h*, two screw hole portions 162*i*, and four first spring seats (not illustrated). The drawer-side holder 162 has a first contact surface 162*j*, a through-hole 162*k*, two first flat surfaces 162*m*, and two second flat surfaces (not illustrated).

The two first wall portions 162*a* are arrayed with each other in the second direction with a space therebetween. The two first wall portions 162*a* extend perpendicular to the second direction, and are parallel to each other.

The two second wall portions 162*b* are arrayed with each other in the first direction with a space therebetween. The two second wall portions 162*b* extend perpendicular to the first direction, and are parallel to each other.

The two first wall portions 162*a* and the two second wall portions 162*b* constitute a box-like body in a form of a polygonal sleeve. The partitioning plate 162*c* is positioned inside the box shaped sleeve so as to partition the interior of the box shaped sleeve into two regions in the third direction. The partitioning plate 162*c* extends perpendicular to the third direction.

The through-hole 162*k* is positioned at a center portion of the partitioning plate 162*c*. The through-hole 162*k* extends throughout a thickness of the partitioning plate 162*c* in the third direction. The through-hole 162*k* has a generally rectangular shape having a pair of long sides extending in the first direction and a pair of short sides extending in the second direction as viewed in the third direction.

The two guide portions 162*d* are arrayed with each other in the first direction with a space therebetween and are parallel to each other. One of the guide portions 162*d* is positioned at an outer surface of one of the second wall portions 162*b* positioned at the one side in the first direction. The one of the guide portions 162*d* has a hollow shape extending in the third direction. The other one of the guide portions 162*d* is positioned at an inner surface of the other one of the second wall portions 162*b* positioned at the other side in the first direction. The other one of the guide portions 162*d* has a hollow shape extending in the third direction.

Each guide portion 162*d* has one end and another end in the third direction, the one end being positioned at the one side in the third direction, the other end being positioned at the other side in the third direction. The one ends in the third direction of the guide portions 162*d* are closed. The other ends in the third direction of the guide portions 162*d* are open.

The four polygonal sleeve portions 162*e* protrude from the first wall portions 162*a* in the second direction outward of the box-like body. One of the polygonal sleeve portions 162*e* protrudes toward the one side in the second direction from the one of the first wall portions 162*a* positioned at the one side in the second direction, and specifically, protrudes from a region closer to one end in the first direction of the one of the first wall portions 162*a* than the center portion in the first direction of the one of the first wall portions 162*a*.

Another one of the polygonal sleeve portions 162*e* protrudes toward the one side in the second direction from the one of the first wall portions 162*a* positioned at the one side in the second direction, and specifically, protrudes from a region closer to another end in the first direction of the one of the first wall portions 162*a* than is the center portion in the first direction of the one of the first wall portions 162*a*.

Still another one of the polygonal sleeve portions 162*e* protrudes toward the other side in the second direction from the other one of the first wall portions 162*a* positioned at the other side in the second direction, and specifically, protrudes from a region closer to one end in the first direction of the other one of the first wall portions 162*a* than is the center portion in the first direction of the other one of the first wall portions 162*a*.

Remaining one of the polygonal sleeve portions 162*e* protrudes toward the other side in the second direction from the other one of the first wall portions 162*a* positioned at the other side in the second direction, and specifically, protrudes from a region closer to another end in the first direction of the other one of the first wall portions 162*a* than is the center portion in the first direction of the other one of the first wall portions 162*a*.

The four polygonal sleeve portions 162*e* are at corner portions of an imaginary rectangle as viewed in the third direction. Each of the polygonal sleeve portions 162*e* is partitioned by the partitioning plate 162*c* at an intermediate position in the third direction. A partitioned portion of each of the polygonal sleeve portions 162*e* positioned at the other side in the third direction from the partitioning plate 162*c* functions as a spring chamber in which a corresponding one of the coil springs 164 is accommodated. A first spring seat is positioned at a portion of the partitioning plate 162*c* positioned in each polygonal sleeve portion 162*e* and facing the other side in the third direction.

Each of the two polygonal sleeve portions 162*e* positioned at the one side in the first direction has one end portion in the third direction, the one end portion being positioned at the one side in the third direction. The first contact surface 162*j* extends outward of the box-like body from the one end portions of the two polygonal sleeve portions 162*e* positioned at the one side in the first direction. The first contact surface 162*j* is flush with each of the end faces in the third direction of the two polygonal sleeve portions 162*e*. The first contact surface 162*j* is a flat plane perpendicular to the third direction.

The first protrusion 162*f* protrudes outward of the box-like body from the first wall portion 162*a* positioned at the other side in the second direction. The first protrusion 162*f* extends in the second direction. The first protrusion 162*f* has a U-shape cross-section taken along a plane perpendicular to the second direction such that an open-end portion of the U-shape is positioned at the one side in the third direction.

The third protrusion 162*h* protrudes outward of the box-like body from the first wall portion 162*a* positioned at the one side in the second direction. The third protrusion 162*h* extends in the second direction. The third protrusion 162*h* has a U-shape cross-section taken along a plane perpendicular to the second direction such that an open-end portion of the U-shape is positioned at the one side in the third direction.

The two second protrusions 162*g* is respectively positioned at the two polygonal sleeve portions 162*e* positioned at the one side in the second direction. Each of the two second protrusions 162*g* protrudes outward of the box-like body from a wall surface of a corresponding one of the two polygonal sleeve portions 162*e*. The two second protrusions extend in the second direction.

The two screw hole portions 162*i* are positioned at the partitioning plate 162*c* and are arrayed with each other in the first direction. The through-hole 162*k* is positioned between the two screw hole portions 162*i* in the first direction. Each of the screw hole portions 162*i* has a hollow cylindrical shape extending in the third direction, and has an inner peripheral surface formed with an internal thread. Each of the screw hole portions 162*i* has one end and another end in the third direction, the one end being positioned at the one side in the third direction, the other end being positioned at the other side in the third direction. The one end of each of the screw hole portions 162*i* is opened, and the other end of each of the screw hole portions 162*i* is closed.

Each of the two guide portions 162*d* has an outer surface positioned at the one side in the second direction. The two first flat surfaces 162*m* are respectively positioned at the outer surfaces positioned at the one side in the second direction of the two guide portions 162*d*. Each of the first flat surfaces 162*m* is in the form of a flat plane extending perpendicular to the second direction. Each of the first flat surfaces 162*m* is positioned toward the one side in the second direction than components in ambient regions.

Each of the two guide portions 162*d* also has an outer surface positioned at the other side in the second direction. The two second flat surfaces are respectively positioned at the outer surfaces positioned at the other side in the second direction of the two guide portions 162*d*. Each of the second flat surfaces is in the form of a flat plane extending perpendicular to the second direction. Each of the second flat surfaces is positioned toward the other side in the second direction than components in ambient regions.

<1-4-3. Structure of Drawer-Side Connector>

A structure of the drawer-side connector 161 will next be described with reference to FIGS. 7 and 9. FIG. 9 illustrates a perspective view of the drawer-side connector 161 as viewed in a direction different from the viewing direction in FIG. 7.

The drawer-side connector 161 includes a female terminal portion 161*a*, a box-like portion 161*b*, a pair of flange portions 161*c*, and a fitting portion 161*e*, and is formed with a pair of through-hole portions 161*d*.

As illustrated in FIG. 9, the female terminal portion 161*a* is positioned inside the box-like portion 161*b*. In the female terminal portion 161*a*, a plurality of terminals are arrayed on a flat plane as viewed in the third direction. Specifically, in the female terminal portion 161*a* of the present embodiment, two terminals are arrayed with each other in the second direction and five terminals are arrayed in a line in the first direction although these terminals are not illustrated in FIG. 9.

The box-like portion 161*b* has two long sides extending in the first direction and two short sides extending in the second direction. The two long sides are spaced away from each other in the second direction and parallel to each other. The two short sides are spaced away from each other in the first direction and parallel to each other. The box-like portion 161*b* has a polygonal hollow shape extending in the third direction. The female terminal portion 161*a* is positioned at an inner surface of the box-like portion 161*b*.

The two flange portions 161*c* extend outward in the first direction from two short sides of the box-like portion 161*b*, respectively. Each of the flange portions 161*c* extends perpendicular to the third direction. Each of the two through-hole portions 161*d* is positioned at a center portion of a corresponding one of the two flange portions 161*c*. Each of the through-hole portions 161*d* extends throughout a thickness of a corresponding one of the flange portions 161*c* in the third direction. Each of the through-hole portions 161*d* is formed at a position corresponding to a corresponding one of the screw hole portions 162*i* of the drawer-side holder 162.

The fitting portion 161*e* is positioned at the one side in the third direction than the box-like portion 161*b* and protrudes in the third direction toward the one side. The fitting portion 161*e* has a generally rectangular shape as viewed in the third direction. The fitting portion 161*e* has a shape so as to fit with the through-hole 162*k* of the drawer-side holder 162.

<1-4-4. Structure of Coil Spring>

Figure 8:
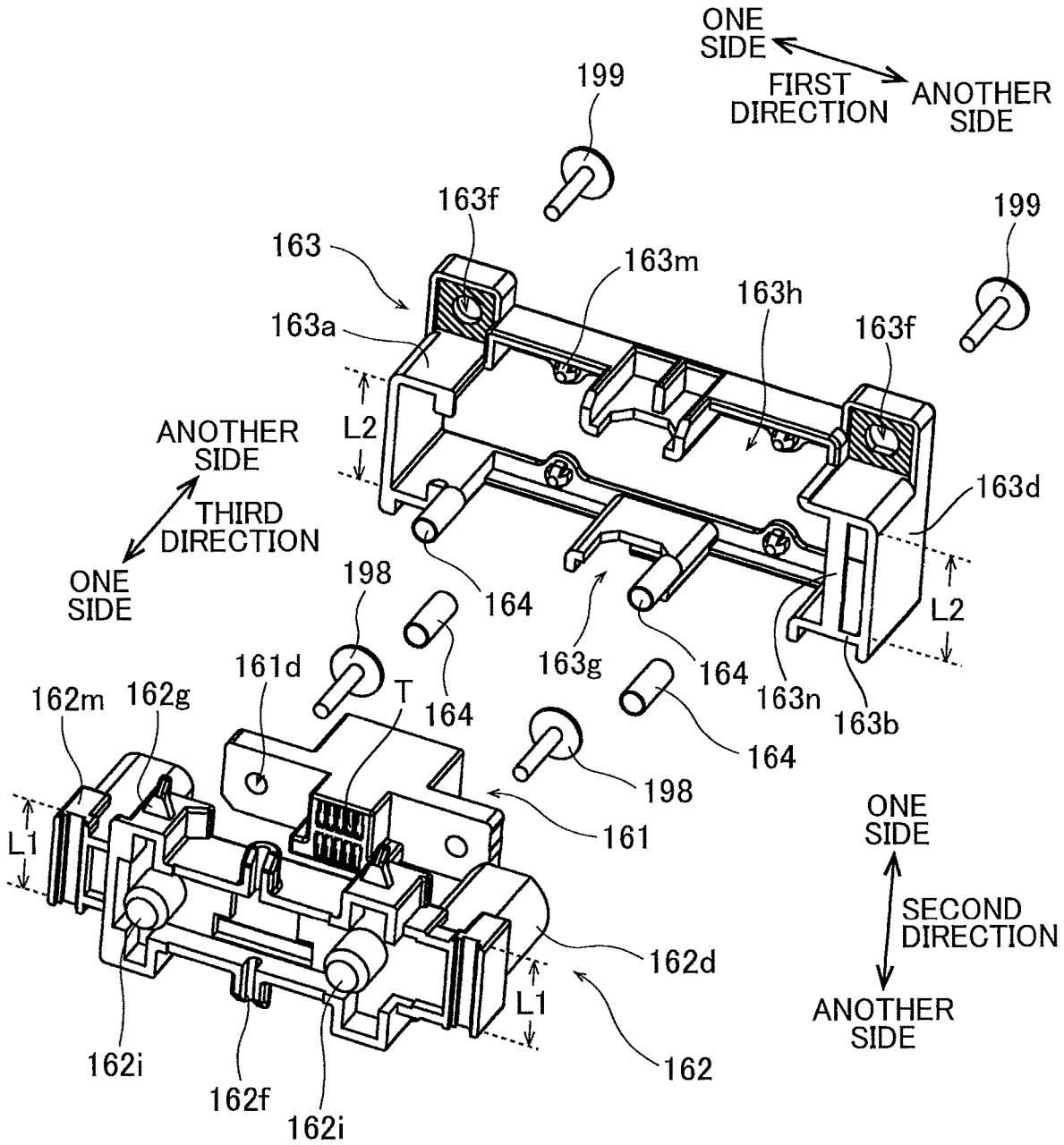
FIG. 8 is an exploded perspective view of the drawer-side connecting portion.

Next, a structure of the coil spring 164 will be described with reference to FIGS. 6 and 8. The coil spring 164 is an elastic member in a form of a metal line helically wound. Each of the four coil springs 164 is interposed between the cover 163 and the drawer-side holder 162. The coil spring 164 can be compressed and stretched in the third direction. Further, the coil spring 164 is deformable in a radial direction of the helix.

Each of the coil springs 164 is displaceable to a first state and a second state. In the first state, the coil spring 164 has a first length in the third direction. In the second state, the coil spring 164 has a second length smaller than the first length in the third direction. As described later, each of the coil springs 164 has one end portion and another end portion in the third direction, the one end portion being positioned at the one side in the third direction, the other end portion being positioned at the other side in the third direction. The one end portion in the third direction of each of the coil springs 164 is connected to a corresponding one of the first spring seats of the drawer-side holder 162. The other end portion in the third direction of each of the coil springs 164 is connected to a corresponding one of the second spring seats 163*m* of the cover 163.

<1-4-5. Structure of Drawer Frame>

A structure of the drawer frame 12 will be next described in detail with reference to FIG. 9. For the attachment of the drawer-side connecting portion 16 to the drawer frame 12, the drawer frame 12 is formed with a through-hole portion 12*a*, and includes four second contact surfaces 12*b*, and two threaded through-hole portions 12*c*.

The through-hole portion 12*a* is a through-hole through which the wirings extending from the terminals T of the drawer-side connecting portion 16 extend. Specifically, the through-hole portion 12*a* has a configuration so that the fitting portion 161*e* of the drawer-side connector 161 can be fitted with the through-hole portion 12*a*.

Each of the four second contact surfaces 12*b* is a flat surface extending perpendicular to the third direction. Each of the second contact surfaces 12*b* is positioned toward the other side in the third direction than components in ambient regions. The four second contact surfaces 12*b* are positioned to surround the through-hole portion 12*a* as viewed in the third direction. Two of the four second contact surfaces 12*b* are arrayed with each other in the first direction, and remaining two of the four second contact surfaces 12*b* are arrayed with each other in the first direction. One of the two threaded through-hole portions 12*c* is positioned at the one side in the first direction than the two second contact surfaces 12*b* arrayed with each other in the first direction. The other of the two threaded through-hole portions 12*c* is positioned at the other side in the first direction than the two second contact surfaces 12*b* arrayed with each other in the first direction.

Each of the two threaded through-hole portions 12*c* has a hollow cylindrical shape extending in the third direction. Each of the threaded through-hole portions 12*c* has an inner peripheral surface formed with an internal thread. The threaded through-hole portions 12*c* are at positions respectively corresponding to the through-holes 163*f* in the cover 163.

<1-5. Assembling Drawer-Side Connecting Portion>

The drawer-side connector 161, the drawer-side holder 162, the cover 163, the coil springs 164, the drawer frame 12, screws 198, 199 are assembled together to provide the drawer-side connecting portion. Assembling manner will be described with reference to FIGS. 8 and 9. FIG. 8 is an exploded perspective view of a part of the drawer-side connecting portion 16. FIG. 9 is another exploded perspective view of the drawer-side connecting portion 16 as viewed in a direction different from the viewing direction in FIG. 8.

First, the drawer-side connector 161 is attached to the drawer-side holder 162 under the condition that the drawer-side connector 161 is positioned at the other side in the third direction with respect to the drawer-side connector 161. At this time, the fitting portion 161*e* of the drawer-side connector 161 is inserted in the through-hole 162*k* of the drawer-side holder 162, and each of the through-hole portion 161*d* is in linear alignment with a corresponding one of the screw hole portions 162*i* in the third direction. In this state, a shaft of each of the screws 198 is inserted into a corresponding one of the through-hole portions 161*d* from the other side in the third direction of the corresponding one of the screw hole portions 162*i*. The shaft of each of the screws 198 is formed with the external thread corresponding to the internal thread formed on each of the screw hole portions 162*i*, and is threadingly engaged with the corresponding one of the screw hole portions 162*i*. In this way, the drawer-side connector 161 is attached to the drawer-side holder 162.

Then, the one end portion in the third direction of each of the four coil springs 164 is attached to a corresponding one of the first spring seats of the drawer-side holder 162. In this state, an assembly of the drawer-side connector 161, the drawer-side holder 162, and the coil springs 164 is assembled to the cover 163. More specifically, the other end portion in the third direction of each of the four coil springs 164 is attached to a corresponding one of the second spring seats 163*m* of the cover 163. At this time, the first wall portions 162*a* and the second wall portions 162*b* of the drawer-side holder 162 are positioned at the other side in the third direction with respect to the bar 163*n* of the cover 163. Since the box-like body of the drawer-side holder 162 is brought into contact with the bar 163*n*, the drawer-side holder 162 is unlikely to be released from the cover 163.

Then, an assembly of the drawer-side connector 161, the drawer-side holder 162, the cover 163, and the coil springs 164 is assembled to the drawer frame 12. More specifically, the assembly of the drawer-side connector 161, the drawer-side holder 162, the cover 163, and the coil springs 164 is positioned to overlap with a region of the drawer frame 12 to which the drawer-side connecting portion 16 is to be connected in a state where the cover 163 faces the other side in the third direction.

At this time, each of the through-holes 163*f* of the cover 163 is in linear alignment with a corresponding one of the threaded through-hole portions 12*c* of the drawer frame 12 in the third direction. Then, the shaft of each of the screws 199 is inserted in a corresponding one of the through-holes 163*f*, and is threadingly engaged with a corresponding one of the threaded through-hole portions 12*c* of the drawer frame 12. The shaft of each of the screws 199 has an outer peripheral surface formed with an external thread. The external thread of the screw 199 corresponds to the internal thread of the threaded through-hole portion 12*c*. In this way, the cover 163 is assembled to the drawer frame 12 with the drawer-side holder 162 and the coil springs 164 interposed therebetween.

In this state, the drawer-side connector 161 is positioned inside the through-hole 163*k* of the cover 163 as viewed in the third direction. Further, the first protrusion 162*f* is positioned in the first groove 163*g*. A gap is provided in the first direction between the first protrusion 162*f* and the first groove 163*g*.

The two second protrusions 162*g* include one second protrusion 162*g* and the other second protrusion 162*g*, the one second protrusion 162*g* being positioned at the one side in the first direction, the other second protrusion 162*g* being positioned at the other side in the first direction. The two second grooves 163*h* include one second groove 163*h* and the other second groove 163*h*, the one second groove 163*h* being positioned at the one side in the first direction, the other second groove 163*h* being positioned at the other side in the first direction. The one second protrusion 162*g* is positioned inside the one second groove 163*h*, and the other second protrusion 162*g* is positioned inside the other second groove 163*h*. A gap is provided in the first direction between each of the two second protrusions 162*g* and a corresponding one of the two second grooves 163*h*.

The third protrusion 162*h* is positioned inside the third groove 163*i*. A gap is provided in the first direction between the third protrusion 162*h* and the third groove 163*i*.

Further, the first contact surface 162*j* faces two second contact surfaces 12*b* in the third direction. More specifically, two of the four second contact surfaces 12*b* are positioned at the one side in the first direction, and remaining two of the four second contact surfaces 12*b* are positioned at the other side in the first direction. The first contact surface 162*j* faces the two second contact surfaces 12*b* positioned at the one side in the first direction. A gap in the third direction is provided as a marginal clearance between the first contact surface 162*j* and the two second contact surfaces 12*b* positioned at the one side in the first direction in a state where the drawer 10 is positioned outside the housing 61.

<1-6. Motion of Drawer-Side Connecting Portion>

Next, motion of the drawer-side connecting portion 16 thus assembled to the drawer frame 12 will be described.

In the drawer-side connecting portion 16, each of the coil springs 164 positioned between the drawer-side holder 162 and the cover 163 is stretched with a stretched length greater than its natural length. Hence, the drawer-side holder 162 is normally urged toward the cover 163 positioned at the other side in the third direction. Here, the first protrusion 162*f* is movable only within a range defined by the first groove 163*g*, and the third protrusion 162*h* is movable only within a range defined by the third groove 163*i*. Thus, the position in the third direction of the assembly of the drawer-side connector 161 and the drawer-side holder 162 is maintained at a constant position in a state where the drawer-side connecting portion 16 is out of contact with the main body-side connecting portion 65.

The first protrusion 162*f* has a closed end at the other side in the third direction, and the third protrusion 162*h* has a closed end at the other side in the third direction. The first groove 163*g* has a bottom portion (a tapered end portion) at the other side in the third direction, and the third groove 163*i* has a bottom portion (a tapered end portion) at the other side in the third direction. In the depicted embodiment, the closed ends of the first protrusion 162*f* and the third protrusion are respectively in contact with the bottom portions of the first groove 163*g* and the third groove 163*i* because of the urging force of the coil springs 164. Hence, the position in the third direction of the assembly of the drawer-side connector 161 and the drawer-side holder 162 can be fixed in an accurate manner.

However, the coil springs 164 are held in a state where they can be compressed toward the one side in the third direction. Therefore, in response to application of external force to the drawer-side connector 161 due to contact of the drawer-side connector 161 with the main body-side connector 651, the position of the assembly of the drawer-side connector 161 and the drawer-side holder 162 changeable in the first direction and the second direction as well as in the third direction because of the deformation of the coil springs 164.

Further, as described above, in the drawer-side connecting portion 16, a gap is provided between an outer surface of the first protrusion 162*f* and an inner surface of the first groove 163*g* in the first direction. Furthermore, in the drawer-side connecting portion 16, a gap is provided in the first direction between an outer surface of the one second protrusion 162*g* provided at the one side in the first direction and an inner surface of the one second groove 163*h* provided at the one side in the first direction, and a gap is provided in the first direction between an outer surface of the other second protrusion 162*g* provided at the other side in the first direction and an inner surface of the other second groove 163*h* provided at the other side in the first direction. Therefore, the drawer-side connector 161 is movable relative to the cover 163 in the first direction in response to application of external force to the drawer-side connector 161 due to contact of the drawer-side connector 161 with the main body-side connector 651.

However, movable range of the drawer-side connector 161 and the drawer-side holder 162 in the first direction is restricted, since the first protrusion 162*f* is movable only within the range defined by the first groove 163*g* and each of the second protrusions 162*g* is movable only within the range defined by a corresponding one of the second grooves 163*h*. Therefore, stabilized movement of the drawer-side holder 162 can be obtained.

Further, a distance L1 (FIGS. 7 and 8) between each of the first flat surfaces 162*m* and a corresponding one of the second flat surfaces in the drawer-side holder 162 is shorter than a distance L2 (FIGS. 6 and 8) between an inner surface of each of the first side walls 163*a* and an inner surface of a corresponding one of the second side walls 163*b* in the cover 163 (L1<L2). Therefore, the drawer-side connector 161 is movable in the second direction relative to the cover 163 in response to application of external force to the drawer-side connector 161 due to contact of the drawer-side connector 161 with the main body-side connector 651 and the like. However, the movement of the drawer-side connector 161 and the drawer-side holder 162 in the second direction relative to the cover 163 is restricted by the abutment of the first flat surfaces 162*m* and the second flat surfaces with respective ones of the inner surfaces of the first side wall 163*a* and the inner surfaces of the second side wall 163*b*.

Further, in a state where the drawer 10 is brought to the attachment position upon completion of setting to the internal space 610 of the housing 61, the coil springs 164 is further stretchable by the length of the marginal clearance between the first contact surface 162*j* and the two second contact surfaces 12*b* positioned at the one side in the first direction. As a result, the first contact surface 162*j* is brought into contact with the two second contact surfaces 12*b*. The contact can obviate application of an excessive load to the coil springs 164.

<1-7. Motion of Drawer-Side Connecting Portion and Main Body-Side Connecting Portion>

Next, motion of the drawer-side connecting portion 16 and the main body-side connecting portion 65 at a time of connection therebetween will be described.

For connecting the drawer-side connecting portion 16 to the main body-side connecting portion 65, first, one of the two protrusions 653 of the main body-side connecting portion 65 is guided along and into a corresponding one of the two guide portions 162*d*, and the other one of the two protrusions 653 of the main body-side connecting portion 65 is guided along and into the other one of the two guide portions 162*d*. At this time, if there is a positional misalignment between the main body-side connecting portion 65 and the drawer-side connecting portion 16, the drawer-side connector 161 and the drawer-side holder 162 of the drawer-side connecting portion 16 move relative to the drawer frame 12 and the cover 163 during the guiding movement. Hence, the positional relationship between the main body-side connecting portion 65 and the drawer-side connecting portion 16 can be adjusted.

Further, when the drawer 10 approaches the attachment position, the main body-side connector 651 of the main body-side connecting portion 65 is inserted into the interior of the box-like portion 161*b* of the drawer-side connector 161. Accordingly, the terminals T of the drawer-side connecting portion 16 are respectively connected to the terminals of the main body-side connector 651.

<1-8. Structure for Positioning Drawer and Discharge Unit>

Figure 10:
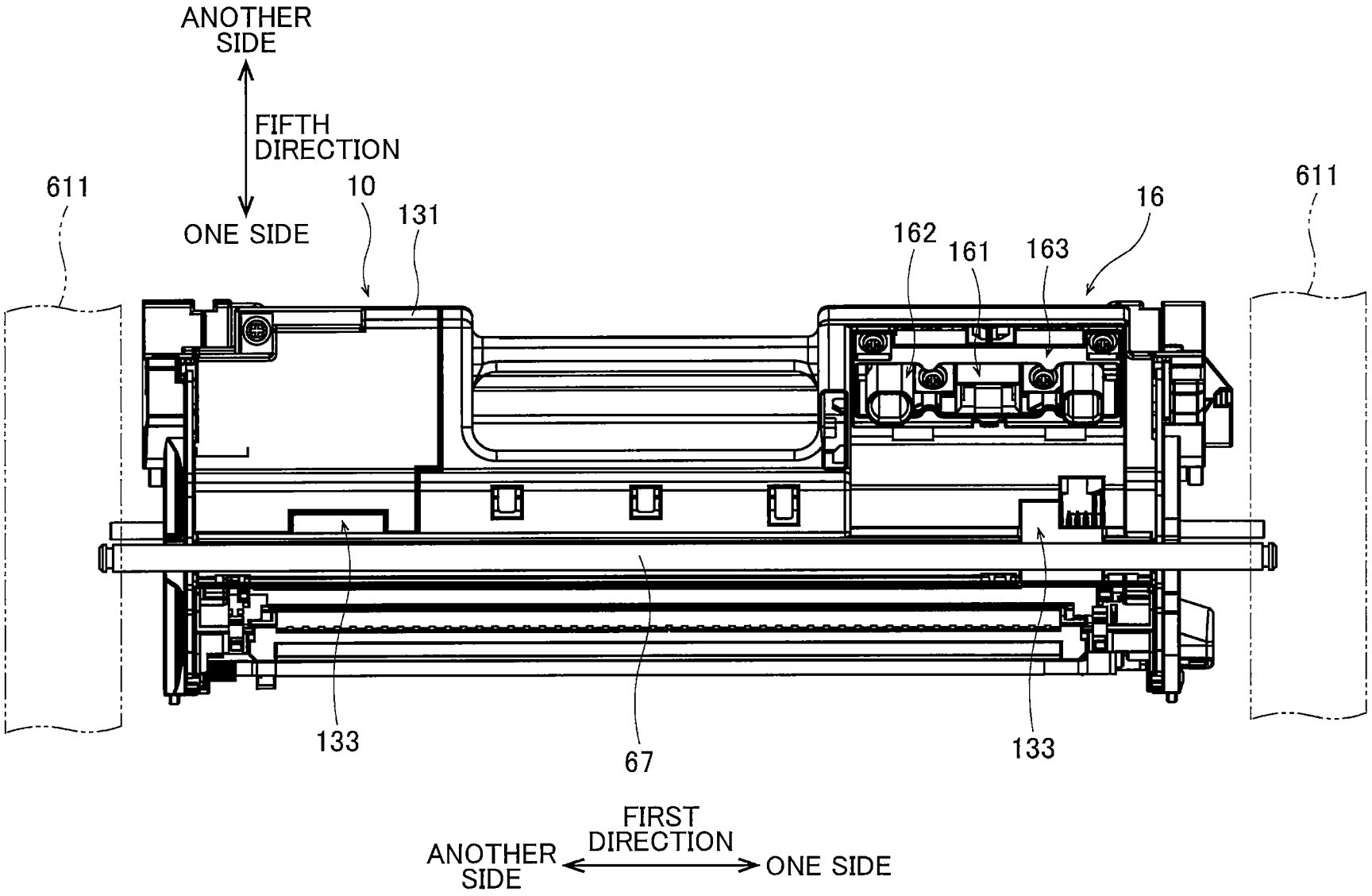
FIG. 10 is a view illustrating the drawer and a reference shaft as viewed from one side in a fourth direction.
Figure 11:
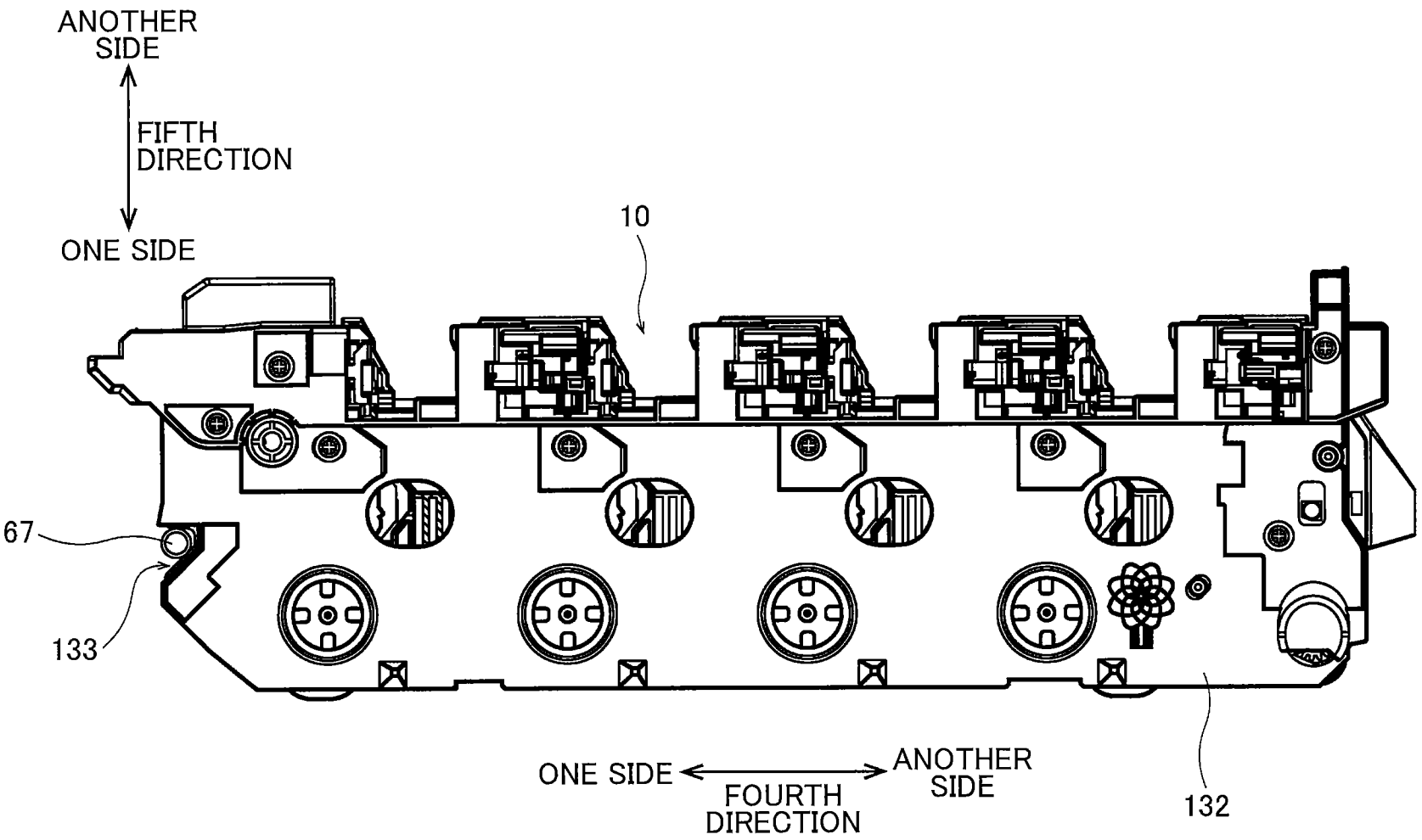
FIG. 11 is a view illustrating the drawer and the reference shaft as viewed from one side in a first direction.
Figure 12:
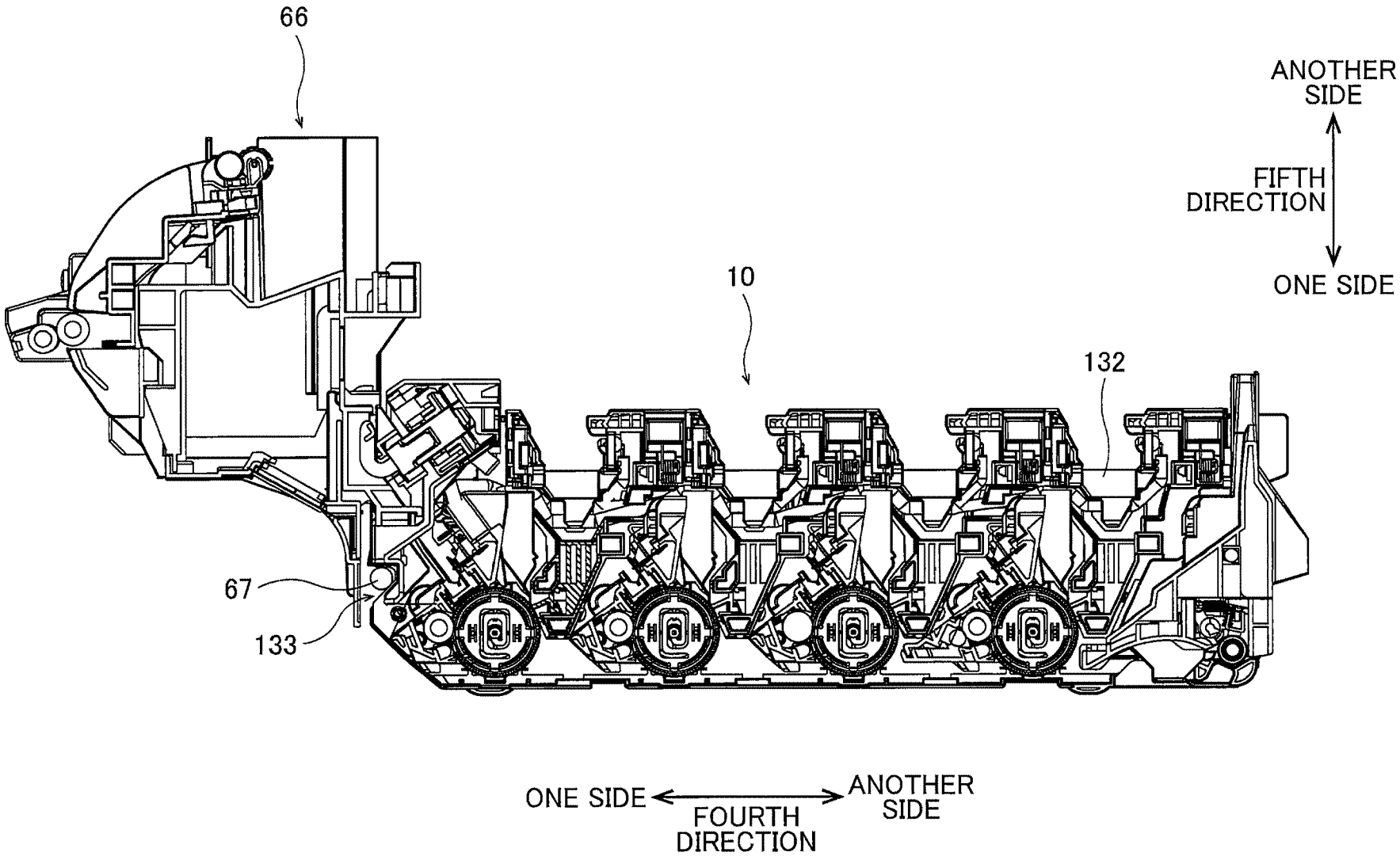
FIG. 12 is a cross-sectional view illustrating the drawer and the reference shaft taken along a plane perpendicular to the first direction.
Figure 14:
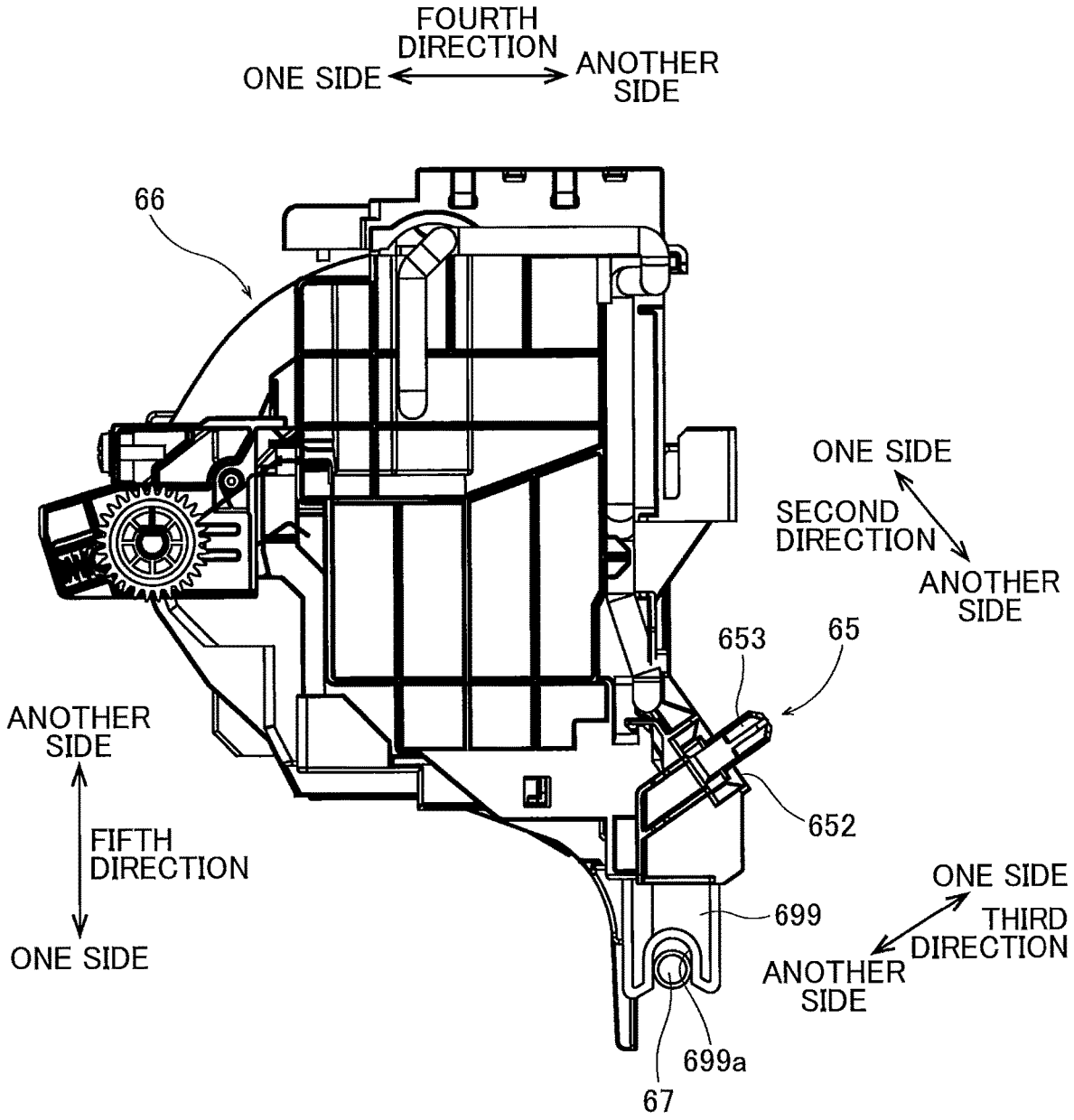
FIG. 14 is a view illustrating the discharge unit and the reference shaft as viewed from the one side in the first direction.

A structure for positioning the drawer 10 and the discharge unit 66 will be described with reference to FIGS. 10 through 14. FIG. 10 is a view illustrating the drawer 10 and the reference shaft 67 as viewed from the one side in the fourth direction. FIG. 11 is a view illustrating the drawer 10 and the reference shaft 67 as viewed from the one side in the first direction. FIG. 12 is a cross-sectional view illustrating the drawer 10 and the reference shaft 67 taken along a plane perpendicular to the first direction. FIG. 13 is a view illustrating the discharge unit 66 and the reference shaft 67 as viewed from the other side in the fourth direction. FIG. 14 is a view illustrating the discharge unit 66 and the reference shaft 67 as viewed from the one side in the first direction.

<1-8-1. Structure for Positioning Drawer>

As a configuration for positioning the drawer 10, the main body 60 of the image forming apparatus 100 includes the reference shaft 67, and the drawer 10 has a pair of recessed portions 133.

As illustrated in FIG. 2, the reference shaft 67 is positioned in the housing 61. The reference shaft 67 has a solid and generally cylindrical shape extending in the first direction. The reference shaft 67 is positioned at the one side in the fifth direction with respect to the discharge unit 66. The reference shaft 67 has one end portion and another end portion in the first direction, the one end portion being positioned at the one side in the first direction, the other end portion being positioned at the other side in the first direction. As illustrated in FIG. 10, the one end portion of the reference shaft 67 is fixed to one side frame 611 of the housing 61 positioned at the one side in the first direction, and the other end portion of the reference shaft 67 is fixed to the other side frame 611 of the housing 61 positioned at the other side in the first direction.

As illustrated in FIG. 11, each of the two recessed portions 133 is positioned at a downstream end portion of the drawer 10 in an inserting direction of the drawer 10. That is, each of the recessed portions 133 is positioned at one side portion of the drawer 10, the one side portion being positioned at the one side in the fourth direction. Specifically, each of the recessed portions 133 is recessed from an outer surface at the one end in the fourth direction of the drawer 10 toward the other side in the fourth direction. The drawer 10 has one end portion and another end portion in the first direction, the one end portion being positioned at the one side in the first direction, the other end portion being positioned at the other side in the first direction. The two recessed portions 133 are respectively positioned at the one end portion and the other end portion of the drawer 10 so as to be aligned with each other in the first direction.

In a case where the drawer 10 is positioned at the attachment position as a result of insertion of the drawer 10 into the internal space 610 of the housing 61, the reference shaft 67 is fitted with the recessed portions 133 of the drawer 10. In a state where the drawer 10 is positioned at the attachment position while being accommodated in the internal space 610 of the housing 61, the recessed portions 133 are in pressure contact with the reference shaft 67. Hence, the drawer 10 is subjected to positioning at the attachment position. Note that the reference shaft 67 is unlikely to be deformed since each of the recessed portions 133 is in pressure contact with the reference shaft 67 at a position outside the center portion of the reference shaft 67 in the first direction as illustrated in FIG. 10.

<1-8-2. Structure for Positioning Discharge Unit>

An installing member 699 is provided for installing the main body-side connecting portion 65 to the discharge unit 66 and the reference shaft 67. The installing member also functions to fix the position of the drawer 10 and the discharge unit 66.

The discharge unit 66 described above is positioned in the internal space 610 of the housing 61 and between the pair of side frames 611 of the housing 61 as illustrated in FIG. 13. The discharge unit 66 is positioned at one end portion in the fourth direction of the internal space 610 of the housing 61 as illustrated in FIG. 1.

The discharge unit 66 has one end portion and another end portion in the fifth direction, the one end portion being positioned at the one side in the fifth direction, the other end portion being positioned at the other side in the fifth direction. As illustrated in FIG. 13, the other end portion in the fifth direction of the discharge unit 66 is fastened to the housing 61 by fastener members 613 such as bolts. Further, the installing member 699 is fixed to the discharge unit 66. Specifically, the installing member 699 is fixed to the one end portion in the fifth direction of the discharge unit 66. The discharge unit 66 has a wall at the other end in the fourth direction, and the installing member 699 extends along the wall of the discharge unit as illustrated in FIG. 14. Further, the installing member 699 is at a position deviated from a center in the first direction of the discharge unit 66 toward the one side in the first direction.

As illustrated in FIGS. 13 and 14, the installing member 699 extends in the fifth direction. The installing member 699 has one end portion at the one side in the fifth direction, and a groove 699*a* opening to the one side in the fifth direction is formed at the one end portion of the installing member 699. The groove 699*a* extends throughout a length in the first direction of the installing member 699. The groove 699*a* is assembled to the reference shaft 67 in a direction from the other side to the one side in the fifth direction. Hence, the reference shaft 67 is inserted in the groove 699*a* of the installing member 699.

As a result, the discharge unit 66 and the reference shaft 67 are connected to each other by way of the installing member 699. The installing member 699 is provided at a part of the main body-side connecting portion 65. In other words, the main body-side connecting portion 65 is supported by the installing member 699. Hence, the main body-side connecting portion 65 is supported by the one end portion in the fifth direction of the discharge unit 66. Accordingly, the one end portion in the fifth direction of the discharge unit 66 is supported by the reference shaft 67 through the installing member 699.

In this way, the discharge unit 66 of the present embodiment can be subjected to accurate positioning since not only the other end portion in the fifth direction but also the one end portion in the fifth direction of the discharge unit 66 are supported. Further, accurate positioning of the drawer-side connector 161 is attained since the drawer-side connecting portion 16 is connected to the main body-side connecting portion 65 which is attached to the discharge unit 66 which has been subjected to accurate positioning.

In another aspect, the main body-side connecting portion 65 is supported with respect to the reference shaft 67 by way of the installing member 699. Further, the drawer-side connecting portion 16 is supported with respect to the reference shaft 67. Therefore, the more accurate positioning can be attained with respect to the main body-side connector 161, since both the main body-side connecting portion 65 and the drawer-side connecting portion 16 is supported with respect to the common reference shaft 67.

<1-9. Positional Relationship Between Housing and Drawer>

Figure 15:
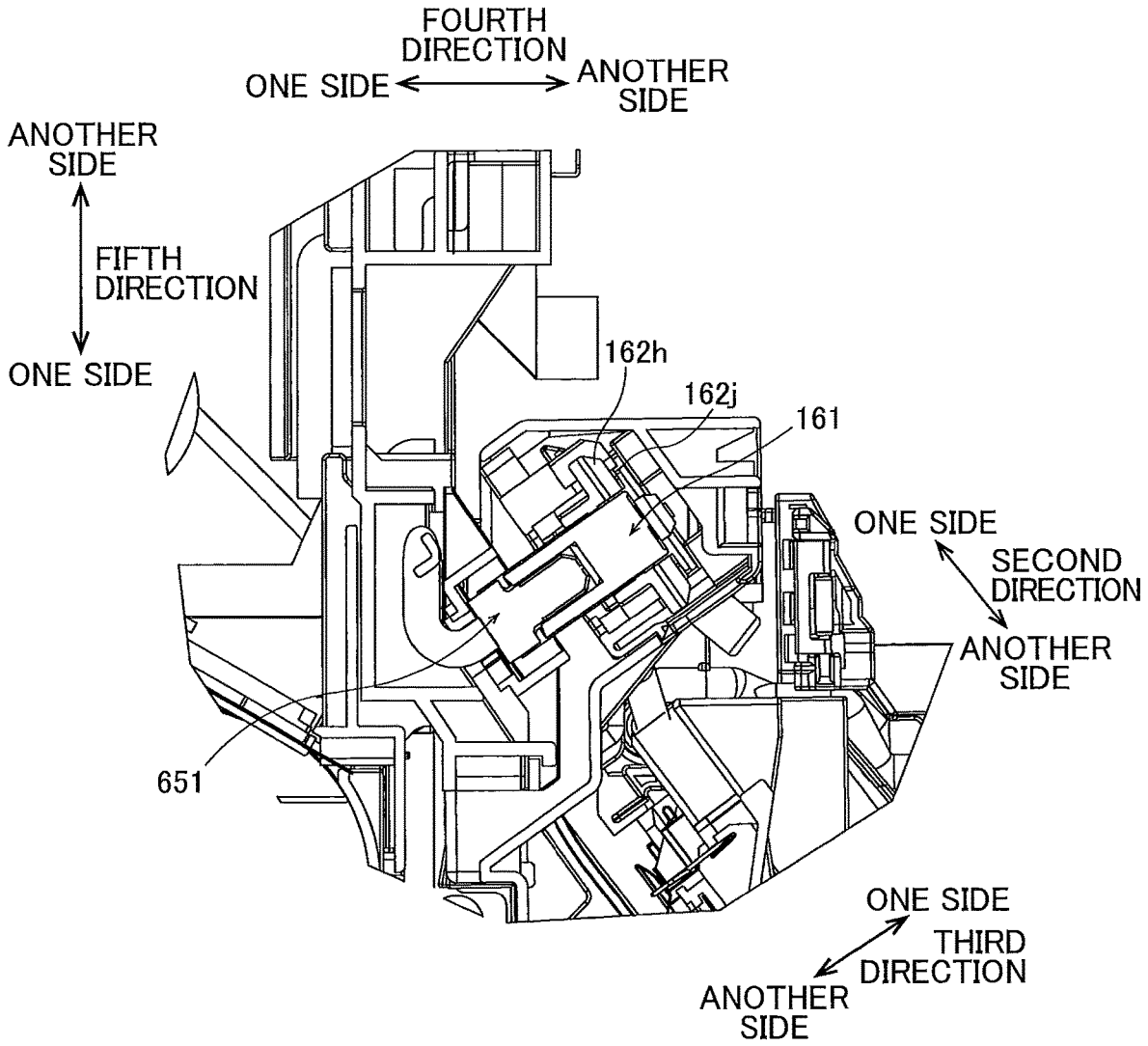
FIG. 15 is a cross-sectional view illustrating the drawer-side connector and a main body-side connector in a state where the image forming apparatus is in a first phase.
Figure 16:
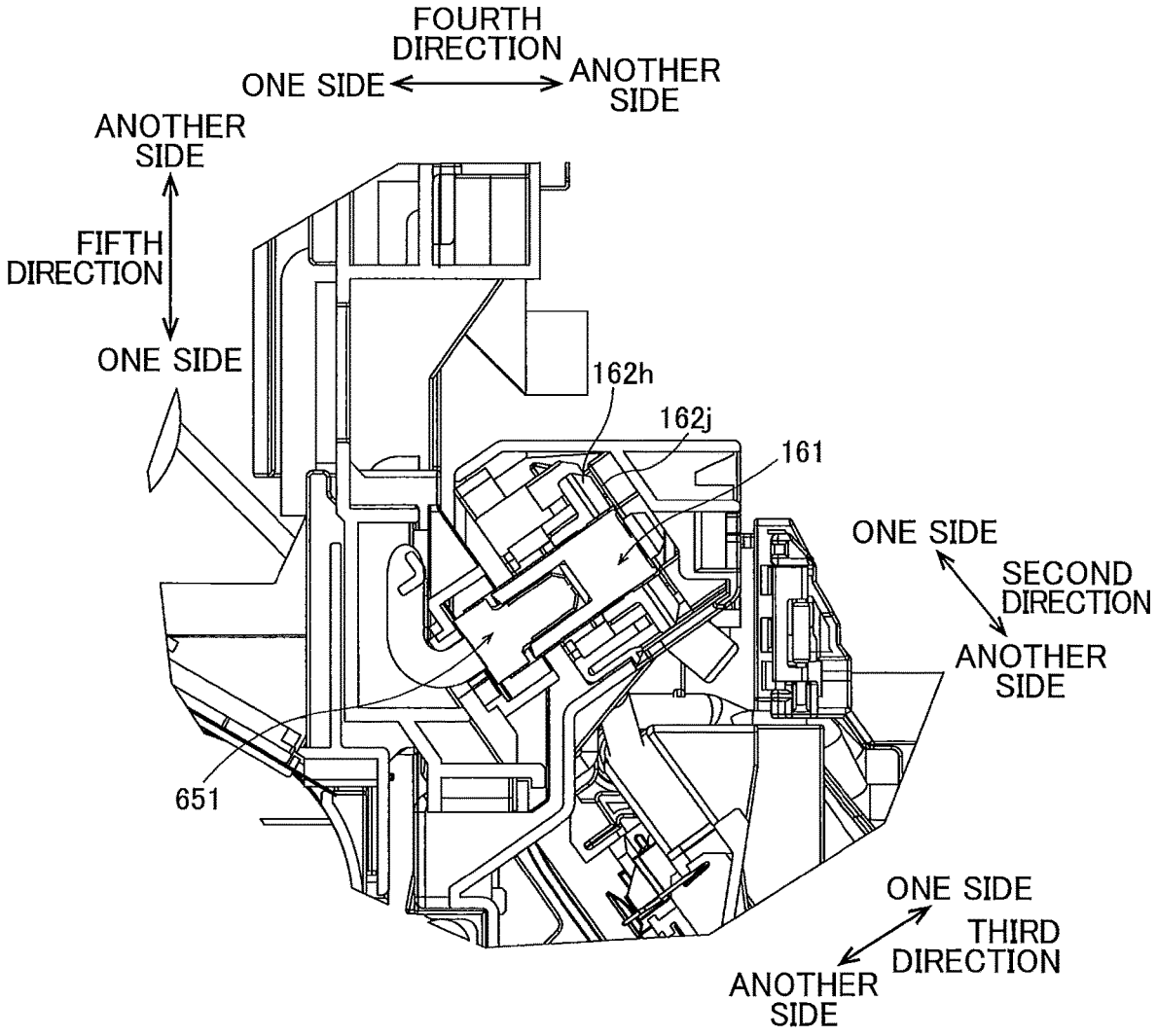
FIG. 16 is a cross-sectional view illustrating the drawer-side connector and the main body-side connector in a state where the image forming apparatus is in a second phase.

A positional relationship between the housing 61 and the drawer 10 will be described with reference to FIGS. 15 and 16. FIG. 15 is a cross-sectional view illustrating the main body-side connector 651 and the drawer-side connector 161 in a state where the image forming apparatus 100 is in a first phase. FIG. 16 is a cross-sectional view illustrating the main body-side connector 651 and the drawer-side connector 161 in a state where the image forming apparatus 100 is in a second phase.

In the image forming apparatus 100, a first phase, a second phase, and a third phase can be provided as a relative positional relationship between the housing 61 and the drawer 10. That is, in a process of setting, to the housing 61, the drawer 10 to which the developing cartridges 14 are attached, the phase of the image forming apparatus 100 transitions from the third phase to the first phase, and then transitions from the first phase to the second phase. In an opposite aspect, in a process of detaching the drawer 10 from the housing 61, the phase of the image forming apparatus 100 transitions from the second phase to the first phase, and then transitions from the first phase to the third phase.

Specifically, as illustrated in FIG. 2, a guide rail 611*a* is provided at an inner surface of each of the pair of side frames 611 of the housing 61. A greater part of each of the guide rails 611*a* extends in the fourth direction, and a minor part positioned at the downstream side (one side) in the fourth direction of the greater part extends in the third direction. A pair of rollers (not illustrated) corresponding to the guide rails 611*a* are respectively provided at outer surfaces of the pair of side plates 132 of the drawer 10. Each of the rollers is rotatably supported by a corresponding one of side plates 132 such that the roller can be in rolling contact with the corresponding guide rail 611*a*.

The housing 61 and the drawer 10 can transition from the third phase to the first phase by moving the rollers of the drawer 10 along the greater parts of the guide rails 611*a* of the housing 61 toward the one side in the fourth direction. Further, at the downstream side in the inserting direction of the drawer 10 in the housing 61, the housing 61 and the drawer 10 can transition from the first phase to the second phase by moving the rollers of the drawer 10 along the minor parts of the guide rails 611*a* toward the one side in the third direction.

<1-9-1. First Phase>

In a state where the image forming apparatus 100 is in the first phase, the drawer 10 is positioned in the internal space 610 of the housing 61, and the front cover 62 is at the open position. Specifically, the user can transition the image forming apparatus 100 to the first phase by pivotally moving the front cover 62 to its open position and pushing the drawer 10 in the inserting direction (toward the one side in the fourth direction) through the opening of the housing 61 opened by the front cover 62. In other words, the image forming apparatus 100 can transition from the third phase to the first phase according to an operation load applied to the drawer 10 by the user.

In the state where the image forming apparatus 100 is in the first phase, the reference shaft 67 is in slight contact with inlet openings of the recessed portions 133. That is, the reference shaft 67 is not completely fitted with the recessed portions 133.

FIG. 15 is a cross-sectional view illustrating the main body-side connector 651 and the drawer-side connector 161 in the state where the image forming apparatus 100 is in the first phase. More specifically, FIG. 15 is the cross-sectional view of the main body-side connector 651 and the drawer-side connector 161 taken along a plane perpendicular to the first direction and passing through a center of the drawer-side connector 161. According to the first phase, the main body-side connector 651 is in contact with the drawer-side connector 161. Specifically, each of the terminals T of the drawer-side connector 161 is in contact with a corresponding one of the terminals of the main body-side connector 651.

According to the first phase illustrated in FIG. 15, external force directing toward the one side in the third direction is applied to the drawer-side holder 162, since the drawer-side connector 161 is urged by the main body-side connector 651 due to the contact therebetween. Accordingly, the coil springs 164 are compressed from the state where the external force is not applied to the drawer-side holder 162. At this time, each of the stretched coil springs 164 has a length smaller than the first length and greater than the second length. Therefore, the first contact surface 162*j* of the drawer-side holder 162 is not in contact with the corresponding two second contact surfaces 12*b* of the drawer frame 12. Accordingly, excessive application of the load to the coil springs 164 and the like due to the operating load to the drawer 10 applied by the user during the pushing operation can be prevented.

<1-9-2. Second Phase>

In a state where the image forming apparatus 100 is in the second phase, the drawer 10 is positioned in the internal space 610 of the housing 61, and the front cover 62 is at the closed position. That is, at this time, the drawer 10 is at the attachment position. Specifically, the user can transition the image forming apparatus 100 to the second phase by pivotally moving the front cover 62 from the open position to the closed position after pushing the drawer 10 in the inserting direction (attachment direction) to provide the first phase. In other words, the image forming apparatus 100 can transition from the first phase to the second phase according to the load applied to the drawer 10 by the front cover 62.

More specifically, a link mechanism (not illustrated) is provided at an inner part of the front cover 62. In accordance with the pivotal movement of the front cover 62 from the open position to the closed position, the drawer 10 is pushed in the inserting direction with an operating load greater than an operating load applied by the user because of interlocking movement of the link mechanism. Hence, the drawer 10 sinks along the minor part of the guide rail 611*a* extending in the third direction. Consequently, the image forming apparatus 100 transitions to the second phase.

In the state where the image forming apparatus 100 is in the second phase, the reference shaft 67 is completely fitted with each of the recessed portions 133. That is, the wall surface of each of the recessed portion 133 is pressed against the peripheral surface of the reference shaft 67.

FIG. 16 is a cross-sectional view illustrating the main body-side connector 651 and the drawer-side connector 161 in the state where the image forming apparatus 100 is in the second phase. More specifically, FIG. 16 is the cross-sectional view of the main body-side connector 651 and the drawer-side connector 161 taken along the plane perpendicular to the first direction and passing through the center of the drawer-side connector 161. In this state, a contact length between the drawer-side connector 161 and the main body-side connector 165 in the third direction is greater than that in the first phase. In other words, a contacting area between the main body-side connector 651 and the drawer-side connector 161 is greater than that in the first phase. More specifically, each of the terminals T of the drawer-side connector 161 is in contact with a corresponding one of the terminals of the main body-side connector 651.

In the second phase illustrated in FIG. 16, the external force directing toward the one side in the third direction is applied to the drawer-side holder 162 due to the function of the link mechanism. Hence, the length in the third direction of each of the coil springs 164 becomes the second length. In this state, the first contact surface 162*j* of the drawer-side holder 162 is contactable with the corresponding two second contact surfaces 12*b* of the drawer frame 12. Therefore, excessive application of the load to the coil springs 164 due to application of the operating load to the drawer 10 can be prevented.

<1-9-3. Third Phase>

In a state where the image forming apparatus 100 is in the third phase, the drawer 10 is partly positioned in the internal space 610 of the housing 61, and the front cover 62 is at the open position. That is, at this time, the drawer 10 is at the released position. Specifically, the user can transition the image forming apparatus 100 to the third phase by pivotally moving the front cover 62 from the closed position to the open position and pulling the drawer 10 in a direction opposite to the inserting direction through the opening of the housing 61 opened by the front cover 62. In the state where the image forming apparatus 100 is in the third phase, no operating load is applied from the user to the drawer 10.

In the state where the image forming apparatus 100 is in the third phase, the reference shaft 67 is out of contact with each of the recessed portions 133, and is apart therefrom.

In the state where the image forming apparatus 100 is in the third phase, the length of each of the coil springs 164 is the first length. In a state where each of the coil springs 164 has the first length greater than the second length, the first contact surface 162*j* of the drawer-side holder 162 is out of contact with the corresponding two second contact surfaces 12*b* of the drawer frame 12. Therefore, in the state where the image forming apparatus 100 is in the third phase, the first contact surface 162*j* of the drawer-side holder 162 is out of contact with the corresponding two second contact surfaces 12*b* of the drawer frame 12, and the first contact surface 162*j* of the drawer-side holder 162 is largely apart from the corresponding two second contact surfaces 12*b* of the drawer frame 12 in comparison with the state where the image forming apparatus 100 is in the first phase or the second phase. Accordingly, even if vibration or impacting force is applied to the image forming apparatus 100, an excessive load is not applied to the components constituting the drawer-side connecting portion 16.

2. Advantageous Effects of Embodiment

As described above, the drawer 10 according to the present embodiment includes the photosensitive drums 11, the drawer frame 12, the drawer-side connector 161, the drawer memory 13, and the drawer-side holder 162. The drawer-side holder 162 is an example of the holder of the present disclosure. The drawer-side holder 162 is movable relative to the drawer frame 12 in the arraying direction of the plurality of terminals T provided in the drawer-side connector 161. In another aspect, the drawer-side holder 162 is movable relative to the drawer frame 12 in the direction (the first direction and the second direction) crossing the attachment direction (the third direction) of the drawer 10 to the main body 60 of the image forming apparatus 100. In still another aspect, the drawer-side holder 162 is movable relative to the drawer frame 12 in at least one of the first direction and the direction crossing the first direction. Accordingly, facilitated connection between the drawer-side connector 161 and the main body-side connector 651 can be attained even if there is a positional displacement between the drawer-side connector 161 and the main body-side connector 651 prior to connection.

Further, in the drawer 10 according to the present embodiment, the drawer-side holder 162 is movable relative to the drawer frame 12 in the third direction crossing both the first direction and the second direction. Therefore, the operating load applied by the user can be absorbed, and the load applied to the drawer-side connector 161 and the main body-side connector 651 can be reduced to connect therebetween.

Further, the drawer 10 according to the present embodiment includes the coil springs 164 as an example of the elastic member pressing the drawer-side holder 162 in the third direction. Thus, elastic deformation of the coil springs 164 can prevent a large load from being applied to the drawer-side connector 161. Further, due to the characteristics that the coil springs 164 are easily compressed and stretched in the axial direction thereof and are also easily deformed in the radial direction thereof, the drawer-side connector 161 can easily move not only in the third direction but also in the directions perpendicular the third direction.

Further, the drawer 10 according to the present embodiment includes four coil springs 164 as an example of the plurality of elastic members of the present disclosure. Hence, stabilized posture of the drawer-side connector 161 can be attained in comparison with a provision of only a single coil spring.

Further, the drawer 10 according to the present embodiment includes the cover 163. The cover 163 covers the outer peripheral surface of the drawer-side holder 162. The cover 163 is fixed to the drawer frame 12. The drawer-side holder 162 is positioned between the drawer frame 12 and the cover 163 in the third direction. Therefore, the drawer-side holder 162 can be attached to the drawer frame 12.

Further, in the drawer 10 according to the present embodiment, the drawer-side holder 162 is brought into contact with the cover 163 in a case where the drawer-side holder 162 moves in the first direction relative to the drawer frame 12. Hence, the cover 163 can restrict the movable range of the drawer-side holder 162 in the first direction.

Further, in the drawer 10 according to the present embodiment, the drawer-side holder 162 is brought into contact with the cover 163 in a case where the drawer-side holder 162 moves in the second direction relative to the drawer frame 12. Hence, the cover 162 can restrict the movable range of the drawer-side holder 162 in the second direction.

Further, in the drawer 10 according to the present embodiment, the drawer-side holder 162 includes the first protrusion 162*f* extending in the second direction as an example of the protrusion of the present disclosure. The cover 163 is formed with the first groove 163*g* as an example of the groove of the present disclosure. The first groove 163*g* has the width in the first direction greater than the length in the first direction of the first protrusion 162*f*. The first protrusion 162*f* is positioned within the first groove 163*g* in a state where the cover 163 is fixed to the drawer frame 12. This structure can restrict the movable range of the drawer-side holder 162 in the first direction since the first protrusion 162*f* is movable only within the first groove 163*g*.

Further, in the drawer 10 according to the present embodiment, the drawer-side holder 162 has the first flat surfaces 162*m* and the second flat surfaces. The cover 163 has the first side wall 163*a* and the second side wall 163*b*. The first flat surface 162*m* is brought into contact with the first side wall 163*a* of the cover 163 in a case where the drawer-side holder 162 moves relative to the drawer frame 12 toward the one end portion of the drawer-side holder 162 positioned at the one side in the second direction. The second flat surface is brought into contact with the second side wall 163*b* of the cover 163 in a case where the drawer-side holder 162 moves relative to the drawer frame 12 toward the other end portion of the drawer-side holder 162 positioned at the other side in the second direction. Hence, the movable range of the drawer-side holder 162 in the second direction can be restricted.

While the description has been made in detail with reference to a specific embodiment, it would be apparent to those skilled in the art that various changes and modifications may be made thereto.

3. Modifications

In the above-described embodiment, the developing cartridges 14 of the respective colors are attached to the drawer 10 serving as the common drum cartridge. Instead, a plurality of process cartridges of respective colors each of which includes a pair of cartridges, i.e., a developing cartridge and a drum cartridge, may be individually attached to a drawer.

In the above-described embodiment, the drawer-side connector 161 provided in the drawer-side connecting portion 16 include the female connector terminals. However, the drawer-side connector may include male connector terminals in place of the female connector terminals. In this case, the main body-side connector includes female connector terminals.

In the above-described embodiment, the plurality of terminals are arrayed in both the first direction and the second direction on the drawer-side connector 161. However, arrays of the terminals may not be oriented in the first direction and the second direction, but may have a directional component of at least one of the first direction and the second direction.

The third protrusion 162*h* and the third groove 163*i* for accommodating the same may be omitted.

In the above-described embodiment, the coil springs 164 are examples of the elastic member of the present disclosure. However, a leaf spring, a sponge, and a rubber may also be available as the elastic member.

The first protrusion 162*f* may be positioned offset from a center in the first direction of the first groove 163*g* as viewed in the second direction in a state where no external force is applied to the drawer-side connector 161.

Throughout the description, the term "memory" or "storage medium" may be a temporary storage medium that is configured to relay data.

While the description has been made for the configuration and the shape of the image forming apparatus in detail with reference to the embodiment and modifications, it would be apparent to those skilled in the art that various changes and modifications may be made thereto.

What is claimed is:

1. A drawer comprising:

a photosensitive drum rotatable about a drum axis extending in a first direction;

a drawer frame holding the photosensitive drum, the drawer frame having an outer surface;

a connector having a plurality of terminals arrayed in an arraying direction;

a drawer memory storing information on the photosensitive drum, the drawer memory being electrically connectable to at least one of the plurality of terminals; and a holder attached to the outer surface of the drawer frame and holding the connector such that the plurality of terminals face away from the drawer frame, the holder being movable relative to the drawer frame in the arraying direction of the plurality of terminals.

2. The drawer according to claim 1, wherein the plurality of terminals is arrayed in the first direction.

3. The drawer according to claim 2, wherein the plurality of terminals is further arrayed in a second direction crossing the first direction.

4. The drawer according to claim 3, wherein the second direction is perpendicular to the first direction.

5. The drawer according to claim 3, wherein the holder is also movable relative to the drawer frame in a third direction crossing both the first direction and the second direction.

6. The drawer according to claim 5, wherein the third direction is perpendicular to both the first direction and the second direction.

7. The drawer according to claim 5, further comprising an elastic member urging the holder in the third direction.

8. The drawer according to claim 7, wherein the elastic member is a coil spring extending in the third direction.

9. The drawer according to claim 7, comprising a plurality of the elastic members.

10. The drawer according to claim 5, further comprising a cover covering an outer peripheral surface of the holder, the cover being fixed to the drawer frame, wherein the holder is positioned between the drawer frame and the cover in the third direction.

11. The drawer according to claim 10, wherein the holder is configured to contact with the cover in a case where the holder moves in the first direction relative to the drawer frame.

12. The drawer according to claim 10, wherein the holder is configured to contact with the cover in a case where the holder moves in the second direction relative to the drawer frame.

13. The drawer according to claim 10, wherein the holder is configured to contact with the cover in a case where the holder moves in the third direction relative to the drawer frame.

14. The drawer according to claim 13, further comprising an elastic member urging the holder in the third direction, the elastic member being positioned between the holder and the cover in the third direction.

15. The drawer according to claim 14, wherein the elastic member extends in the third direction and having one end portion and another end portion in the third direction, wherein the holder has a first spring seat to which the one end portion of the elastic member is connected, and wherein the cover has a second spring seat to which the another end portion of the elastic member is connected.

16. The drawer according to claim 14, wherein the elastic member is displaceable between a first state and a second state, wherein the elastic member has a first length in the third direction in a case where the elastic member is in the first state, wherein the elastic member has a second length in the third direction smaller than the first length in a case where the elastic member is in the second state, and wherein the holder is in contact with the drawer frame in the case where the elastic member is in the first state.

17. The drawer according to claim 16, wherein the holder has a first contact surface which is a flat part of the holder, the first contact surface extending perpendicular to the third direction, wherein the drawer frame has a second contact surface which is a flat part of the drawer frame, the second contact surface extending perpendicular to the third direction, and wherein the first contact surface is in contact with the second contact surface in the case where the elastic member is in the first state.

18. The drawer according to claim 11, wherein the holder comprises a protrusion extending in the second direction, wherein the cover is formed with a groove having a width in the first direction greater than a length of the protrusion in the first direction, and wherein the protrusion is positioned within the groove in a state where the cover is fixed to the drawer frame.

19. The drawer according to claim 18, wherein an outer surface of the protrusion is configured to contact an inner surface of the groove in a case where the holder moves in the first direction relative to the drawer frame.

20. The drawer according to claim 12, wherein the holder has:

a first flat surface extending perpendicular to the second direction, the first flat surface being positioned at one end portion of the holder in the second direction; and a second flat surface extending perpendicular to the second direction, the second flat surface being positioned at another end portion of the holder in the second direction, wherein the cover has:

a first side wall facing the first flat surface in the second direction; and a second side wall facing the second flat surface in the second direction, the second side wall being positioned spaced away from the first side wall in the second direction, wherein the first flat surface is configured to contact with the first side wall in a case where the holder moves relative to the drawer frame in the second direction toward the one end portion of the holder, and wherein the second flat surface is configured to contact with the second side wall in a case where the holder moves relative to the drawer frame in the second direction toward the another end portion of the holder.

21. The drawer according to claim 1, wherein the information on the photosensitive drum stored in the drawer memory is at least one of drum identification information for discriminating the photosensitive drum, a number of rotations of the photosensitive drum, and a number of sheets printed using the photosensitive drum.

22. The drawer according to claim 1, comprising a plurality of the photosensitive drums, wherein the plurality of the photosensitive drums is held by the drawer frame in a state where the plurality of the photosensitive drums is arrayed with each other in a fourth direction crossing the first direction.

23. The drawer according to claim 1, wherein a developing cartridge accommodating therein developing agent is attachable to the drawer.

24. The drawer according to claim 23, wherein the drawer is attachable to a main body of an image forming apparatus in a state where the developing cartridge is attached to the drawer.

25. The drawer according to claim 24, wherein the plurality of terminals of the connector is in contact with a connector of the main body of the image forming apparatus in a state where the drawer is attached to the main body of the image forming apparatus and a front cover of the main body of the image forming apparatus is closed.

26. A drawer for use in a main body of an image forming apparatus, the drawer comprising:

a photosensitive drum rotatable about a drum axis extending in a first direction;

a drawer frame holding the photosensitive drum, the drawer frame having an outer surface;

a connector having a terminal;

a drawer memory storing information on the photosensitive drum, the drawer memory being electrically connectable to the terminal; and a holder attached to the outer surface of the drawer frame and holding the connector such that the terminal faces away from the drawer frame, the holder being movable relative to the drawer frame in a direction crossing an attachment direction in which the drawer is to be attached to the main body of the image forming apparatus.

27. A drawer comprising:

a photosensitive drum rotatable about a drum axis extending in a first direction;

a drawer frame holding the photosensitive drum, the drawer frame having an outer surface;

a connector having a terminal;

a drawer memory storing information on the photosensitive drum, the drawer memory being electrically connectable to the terminal; and a holder attached to the outer surface of the drawer frame and holding the connector such that the terminal faces away from the drawer frame, the holder being movable relative to the drawer frame in at least one of the first direction and a direction crossing the first direction.

* * * * *